US008422037B2

(12) United States Patent
Hodoshima et al.

(10) Patent No.: US 8,422,037 B2
(45) Date of Patent: Apr. 16, 2013

(54) IMAGE FORMING APPARATUS

(75) Inventors: Takashi Hodoshima, Kanagawa (JP); Toshiyuki Andoh, Kanagawa (JP); Takashi Hashimoto, Kanagawa (JP); Hidetaka Noguchi, Hyogo (JP); Seiji Hoshino, Kanagawa (JP); Tatsuhiko Oikawa, Kanagawa (JP); Tetsuo Watanabe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 514 days.

(21) Appl. No.: 12/379,274

(22) Filed: Feb. 18, 2009

(65) Prior Publication Data

US 2009/0207461 A1 Aug. 20, 2009

(30) Foreign Application Priority Data

Feb. 19, 2008 (JP) ..... 2008-037837
Mar. 12, 2008 (JP) ..... 2008-062042

(51) Int. Cl.

| | |
|---|---|
| ***G06F 3/12*** | (2006.01) |
| ***H04N 1/04*** | (2006.01) |
| ***B31B 1/56*** | (2006.01) |
| ***B41J 29/393*** | (2006.01) |
| ***B41J 2/015*** | (2006.01) |
| ***B65H 39/00*** | (2006.01) |
| ***G03G 15/20*** | (2006.01) |
| ***G03G 15/00*** | (2006.01) |

(52) U.S. Cl.

USPC ..... 358/1.1; 358/498; 358/1.15; 493/454; 347/20; 347/19; 270/58.09; 399/407; 399/67

(58) Field of Classification Search ..... 358/498, 358/1.15; 493/454; 347/20, 19; 399/407, 399/67; 270/58.09

See application file for complete search history.

(56) References Cited

U.S. PATENT DOCUMENTS

| | | | | |
|---|---|---|---|---|
| 7,567,762 | B2 | 7/2009 | Ogihara et al. | |
| 2005/0025511 | A1 * | 2/2005 | Watabe | 399/67 |
| 2008/0175612 | A1 | 7/2008 | Oikawa et al. | |
| 2008/0232880 | A1 | 9/2008 | Noguchi et al. | |

FOREIGN PATENT DOCUMENTS

| | | |
|---|---|---|
| JP | 4-242276 | 8/1992 |
| JP | 6-274051 | 9/1994 |
| JP | 2001-92332 | 4/2001 |
| JP | 2001-228777 | 8/2001 |
| JP | 2005-316320 | 11/2005 |
| JP | 2007-286382 | 1/2007 |
| JP | 2007-127949 | 5/2007 |
| JP | 2007-316427 | 6/2007 |

OTHER PUBLICATIONS

Japanese Office Action dated Jun. 29, 2012, issued in corresponding Japanese Application No. 2008-037837.

* cited by examiner

*Primary Examiner* — Charlotte M Baker
*Assistant Examiner* — Rury Grisham
(74) *Attorney, Agent, or Firm* — Harness, Dickey & Pierce, P.L.C.

(57) ABSTRACT

In an image forming apparatus, a distance adjusting unit adjusts an inter-unit distance between a contact unit and an image carrier by moving the image carrier or the contact unit by applying an opposing force to the image carrier or the contact unit against a biasing force applied by a biasing unit based on thickness information of a recording sheet acquired by a thickness-information acquiring unit and data indicating a relationship between the thickness information and an inter-unit distance change amount stored in a data storage unit.

14 Claims, 13 Drawing Sheets

IMAGE FORMING APPARATUS

CROSS-REFERENCE TO RELATED APPLICATIONS

The present application claims priority to and incorporates by reference the entire contents of Japanese priority document 2008-037837 filed in Japan on Feb. 19, 2008 and Japanese priority document 2008-062042 filed in Japan on Mar. 12, 2008.

BACKGROUND OF THE INVENTION

1. Field of the Invention

The present invention relates to an image forming apparatus such as a copy machine, a facsimile machine, and a printer.

2. Description of the Related Art

There is known an image forming apparatus that holds a recording sheet by a transfer nip formed between an image carrier and a contact unit that are in contact with each other and that transfers a toner image being a visible image formed on the image carrier to the recording sheet. In the configuration, if a cardboard is used as the recording sheet, a moving speed of the surface of the image carrier may be momentarily changed by sharp load fluctuation when a leading edge of the cardboard is caused to enter the transfer nip or when a trailing edge thereof is caused to exit from the transfer nip. The change in the moving speed of the surface causes liner uneven density in the image.

Meanwhile, Japanese Patent Application Laid-open No. H4-242276 describes an image forming apparatus that adjusts a distance between an image carrier and a contact unit in the following manner. That is, the image forming apparatus detects the thickness of a recording sheet by a thickness sensor before the recording sheet enters a nip between the image carrier and the contact unit. A moving unit forcibly moves the contact unit away from the image carrier before the leading edge of the recording sheet is caused to enter the nip therebetween. With this feature, a gap of 30% to 90% of a sheet thickness detected by the thickness sensor is provided between the image carrier and the contact unit, and then the recording sheet is caused to enter therebetween. This configuration allows reduction in sharp load fluctuation on the image carrier upon entering of the leading edge of the recording sheet into the gap and upon discharging of the trailing edge thereof from the gap, as compared with a case in which the gap is not provided. This enables minimization of linear uneven density.

Japanese Patent Application Laid-open No. 2001-92332 describes an image forming apparatus that changes a distance between an image carrier and a contact unit in the following manner. That is, first, the contact unit is separated from the image carrier by a predetermined distance before a leading edge of a recording sheet is caused to enter a nip between the image carrier and the contact unit. This allows reduction in sharp load fluctuation on the image carrier upon entering of the leading edge of the recording sheet into the nip. Subsequently, the contact unit is brought close to the image carrier right after the leading edge of the recording sheet is caused to enter the nip between the contact unit and the image carrier mutually separated from each other, to obtain predetermined transfer pressure. Then, the contact unit is again moved away from the image carrier right before the trailing edge of the recording sheet is caused to exit from the nip. This allows reduction in load sharp fluctuation on the image carrier upon exit of the trailing edge of the recording sheet from the nip.

However, in the image forming apparatus described in Japanese Patent Application Laid-open No. H4-242276, a contact depth between the image carrier and the contact unit is not calculated at all, and thus, there is a high probability to cause transfer failure due to low transfer pressure. Specifically, a transfer nip is generally formed as a contact portion between the image carrier and the contact unit to keep a longer transfer time. The surface of a material of at least one of the image carrier and the contact unit is formed with an elastically deformable element, and the element is elastically deformed at the contact portion to form a wide nip. One of the image carrier and the contact unit is biased toward the other one by a spring while the other one is movably held. This is because the element biased by the spring is caused to follow the thickness of a recording sheet entering the transfer nip and escape the other side, and thus, even if the recording sheet is the cardboard, appropriate transfer pressure is obtained while it is caused to reliably enter the transfer nip.

In this configuration, it is assumed that either one of the image carrier and the contact element is forcibly moved by a moving unit from a state of not holding the recording sheet in the transfer nip and is separated little by little from the other one. Then, the size of the transfer nip becomes smaller and smaller, and eventually the element that is moved is separated from the other one. A moving distance required for the separation is nearly the same value as the contact depth between the image carrier and the contact element before the movement.

For example, as shown in FIG. 15, a contact unit 902 is structured so as to be elastically deformable and movable, and the bottom face of a bearing 908 that bears a rotating shaft of the contact unit 902 is biased by a spring 905, to thereby bring the contact unit 902 into contact with an image carrier 901. A contact depth of the image carrier 901 into the contact unit 902 is K1 at this time. By rotating an eccentric cam (not shown) from this state, pressing a cam face thereof against a top surface S of the bearing 908, and forcibly depressing the contact unit 902 downward in FIG. 15, a following state is obtained.

Specifically, as shown in FIG. 16, the contact unit 902 starts separating from the image carrier 901 at a point in time when the moving amount of the contact unit 902 starts exceeding the contact depth K1 caused by forcible depression. In this manner, to cause the contact unit 902 to start separating from the image carrier 901, at first, the contact unit 902 needs to be moved by a distance equal to the contact depth K1. In the image forming apparatus described in Japanese Patent Application Laid-open No. H4-242276, the contact unit is further moved thereafter, and the gap of 30% to 90% of the thickness of the cardboard is provided between the image carrier and the contact unit. The contact depth K1 is set according to a structure of a model; however, if it is an ordinary set value, the contact depth K1 becomes often a value considerably greater than a sheet thickness depending on the thickness of the cardboard. In this case, if the contact unit is separated from the image carrier, required transfer pressure cannot be obtained depending on the thickness of the cardboard, which may cause transfer failure.

In the image forming apparatus described in Japanese Patent Application Laid-open No. 2001-92332, the contact unit is brought close to the image carrier right after the leading edge of the recording sheet is caused to enter between the image carrier and the contact unit to ensure desired transfer pressure. Even so, the transfer failure may occur. Specifically, after the leading edge of the recording sheet is caused to enter therebetween, the contact unit is brought close to the image carrier. The desired transfer pressure cannot be obtained until this operation is completed, and this may cause transfer failure in a region of the leading edge of the recording sheet. Moreover, when the contact unit is moved away from the image carrier before the trailing edge of the recording sheet is caused to exit from the nip between the image carrier and the contact unit, the desired transfer pressure cannot also be obtained, and this may cause transfer failure also in a region of the trailing edge of the recording sheet. In recent years in which the carrying speed of a sheet is being increased to implement high-speed printing, even if a high-speed moving mechanism capable of moving the contact unit at high speed is provided, it is difficult to eliminate a region where transfer failure may occur in the leading edge and the trailing edge of the recording sheet.

SUMMARY OF THE INVENTION

It is an object of the present invention to at least partially solve the problems in the conventional technology.

According to an aspect of the present invention, there is provided an image forming apparatus including an image carrier that includes a first rotating shaft and is rotatable around the first rotating shaft, or that has a belt-shape and is wound around a belt support unit that includes a second rotating shaft and is rotatable around the second rotating shaft; a contact unit that is capable of coming in contact with a surface of the image carrier; a biasing unit that applies a biasing force to either one of the image carrier and the contact unit to be brought into contact with another one of the image carrier and the contact unit; a thickness-information acquiring unit that acquires thickness information of a recording sheet; a distance adjusting unit that adjusts an inter-unit distance between the contact unit and either one of the first rotating shaft and the second rotating shaft by moving the either one of the image carrier and the contact unit by applying an opposing force to the either one of the image carrier and the contact unit against the biasing force based on the thickness information; and a data storage unit that stores therein data indicating a relationship between the thickness information and an inter-unit distance change amount, the inter-unit distance change amount being a change in the inter-unit distance when a state where the distance adjusting unit does not apply the opposing force against the biasing force and the recording sheet is not fed into a nip between the image carrier and the contact unit is shifted to a state where the recording sheet is passed through the nip without the distance adjusting unit applying the opposing force against the biasing force, wherein the distance adjusting unit adjusts the inter-unit distance based on the thickness information and the data stored in the data storage unit to transfer a visible image formed on the surface of the image carrier onto the recording sheet passed through the nip.

According to another aspect of the present invention, there is provided an image forming apparatus including an image carrier that includes a first rotating shaft and is rotatable around the first rotating shaft, or that has a belt-shape and is wound around a belt support unit that includes a second rotating shaft and is rotatable around the second rotating shaft; a contact unit that is capable of coming in contact with a surface of the image carrier; a biasing unit that applies a biasing force to either one of the image carrier and the contact unit to be brought into contact with another one of the image carrier and the contact unit; a distance adjusting unit that adjusts an inter-unit distance between the contact unit and either one of the first rotating shaft and the second rotating shaft by moving the either one of the image carrier and the contact unit by applying an opposing force to the either one of the image carrier and the contact unit against the biasing force; and a distance-change detector that detects an inter-unit distance change amount that is a change in the inter-unit distance when a state where the distance adjusting unit does not apply the opposing force against the biasing force and the recording sheet is not fed into a nip between the image carrier and the contact unit is shifted to a state where the recording sheet is passed through the nip without the distance adjusting unit applying the opposing force against the biasing force, wherein the distance adjusting unit adjusts the inter-unit distance based on the inter-unit distance change amount detected by the distance-change detector to transfer a visible image formed on the surface of the image carrier onto the recording sheet passed through the nip.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings. In the embodiments, as an example of an image forming apparatus to which the present invention is applied, a copy machine that forms an image using an electrophotographic system will be explained below.

Figure 1:
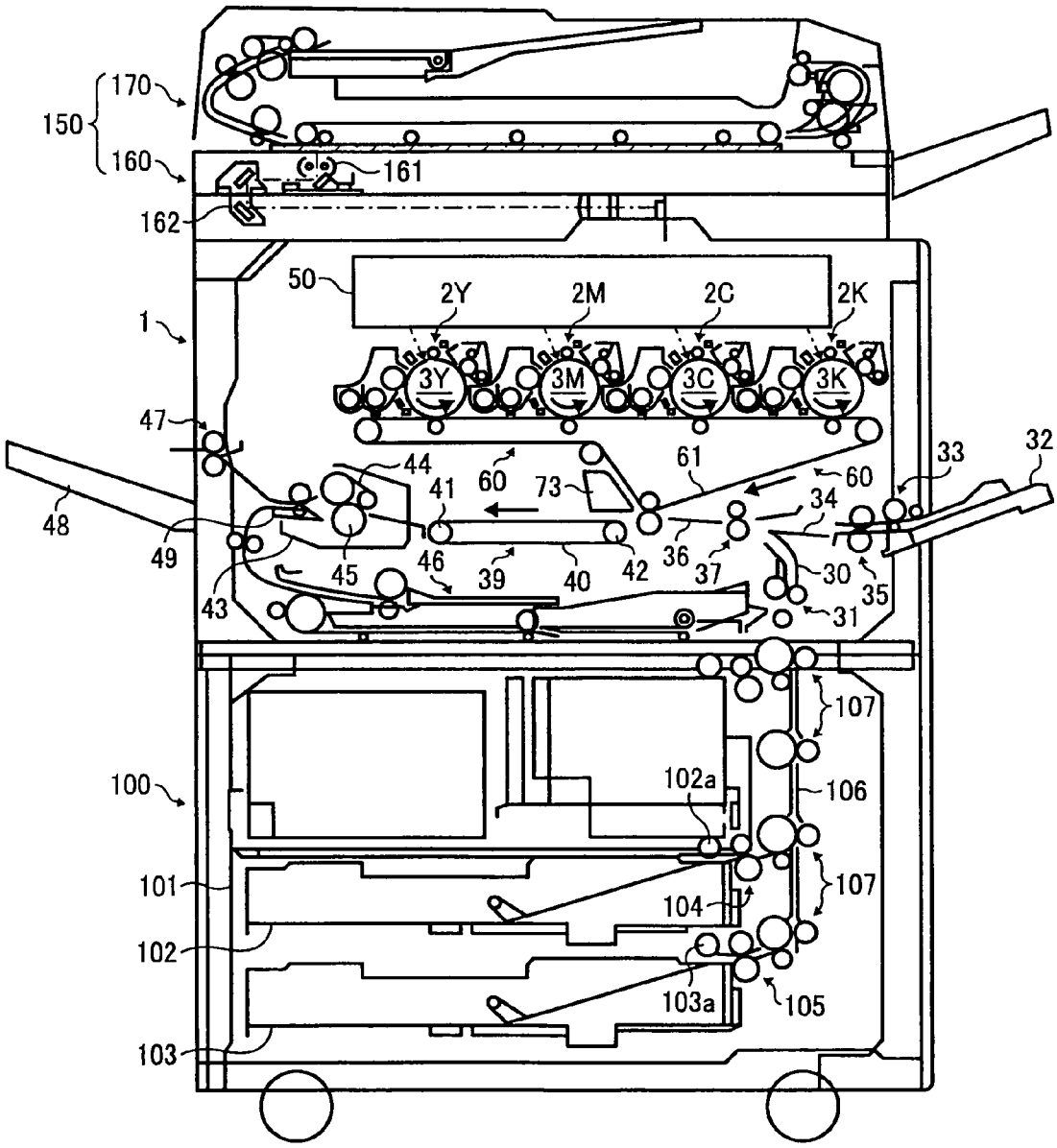
FIG. 1 is a schematic diagram of a general configuration of a copy machine according to a first embodiment of the present invention.

A basic configuration of a copy machine according to a first embodiment of the present invention will be explained below. FIG. 1 is a schematic diagram of a general configuration of a copy machine according to the first embodiment. The copy machine includes a printer 1, a sheet feeding device 100, and an original feeding/reading device 150. The original feeding/reading device 150 includes a scanner 160 being an original reader fixed on the printer 1 and an automatic document feeder (ADF) 170 being an original feeding device supported by the scanner 160.

The sheet feeding device 100 includes sheet feeding cassettes 102 and 103 arranged in a multistage in a sheet bank 101, pairs of separation rollers 104 and 105, a sheet feeding path 106, and a plurality of pairs conveying rollers 107. Each of the sheet feeding cassettes 102 and 103 stores therein stacked recording sheets. A sending roller 102*a* or 103*a* is driven to rotate based on a control signal sent from the printer 1 and a top sheet of the stack of recording sheets is sent out to the separation rollers 104 or 105. The separation rollers 104 or 105 separate a recording sheet from send-out recording sheets and conveys the recording sheet to the sheet feeding path 106. Then, the recording sheet is sent to a first reception-branch path 30 of the printer 1 through each conveying nip between each pair of the conveying rollers 107 arranged along the sheet feeding path 106.

The printer 1 includes process units 2Y, 2M, 2C, and 2K to form toner images of yellow (Y), magenta (M), cyan (C), and black (K), respectively. The printer 1 also includes the first reception-branch path 30, a pair of reception-feed rollers 31, a manual feed tray 32, a pickup roller 33, a second reception-branch path 34, a separation roller 35, a pre-transfer conveying path 36, a pair of registration rollers 37, a conveyor belt unit 39, a fixing unit 43, a switch-back device 46, a pair of sheet-discharging roller 47, a sheet discharging tray 48, a switching claw 49, an optical writing unit 50, and a transfer unit 60. The process units 2Y, 2M, 2C, and 2K include drum-shaped photosensitive elements 3Y, 3M, 3C, and 3K being latent-image carriers, respectively.

The pre-transfer conveying path 36 for conveying a recording sheet is branched into the first reception-branch path 30 and the second reception-branch path 34 right in front of a secondary transfer nip, explained later, in the upstream in a sheet conveying direction. The recording sheet sent-out from the sheet feeding path 106 is received by the first reception-branch path 30 and is sent to the pre-transfer conveying path 36 through a conveying nip between the reception-feed rollers 31 provided in the first reception-branch path 30.

Provided on the side face of a housing of the printer 1 is the manual feed tray 32 so as to be openable with respect to the housing, and the stack of recording sheets is manually put on the top of the tray when it is open with respect to the housing. The top sheet of the stack of the manually put recording sheets is picked up by the pickup roller 33 and then picked up sheets are separated sheet by sheet by the separation roller 35 to be sent to the second reception-branch path 34. Thereafter, the recording sheet is sent to the pre-transfer conveying path 36 through a registration nip between the registration rollers 37.

The optical writing unit 50 includes a laser diode, a polygon mirror, and various lenses which are not shown. The optical writing unit 50 drives the laser diode based on image information read by the scanner 160 explained later or based on image information sent from an external personal computer, and optically scans the photosensitive elements 3Y, 3M, 3C, and 3K, respectively. Specifically, the photosensitive elements 3Y, 3M, 3C, and 3K are driven to rotate in the counterclockwise in FIG. 1 by a drive unit (not shown). The optical writing unit 50 performs an optical scanning process by irradiating the rotating photosensitive elements 3Y, 3M, 3C, and 3K with laser beams (indicated by "L" in FIG. 2, explained later) while deflecting them in a rotating axis direction respectively. Thus, electrostatic latent images are formed on the photosensitive elements 3Y, 3M, 3C, and 3K based on the Y, M, C, and K image information respectively.

Figure 2:
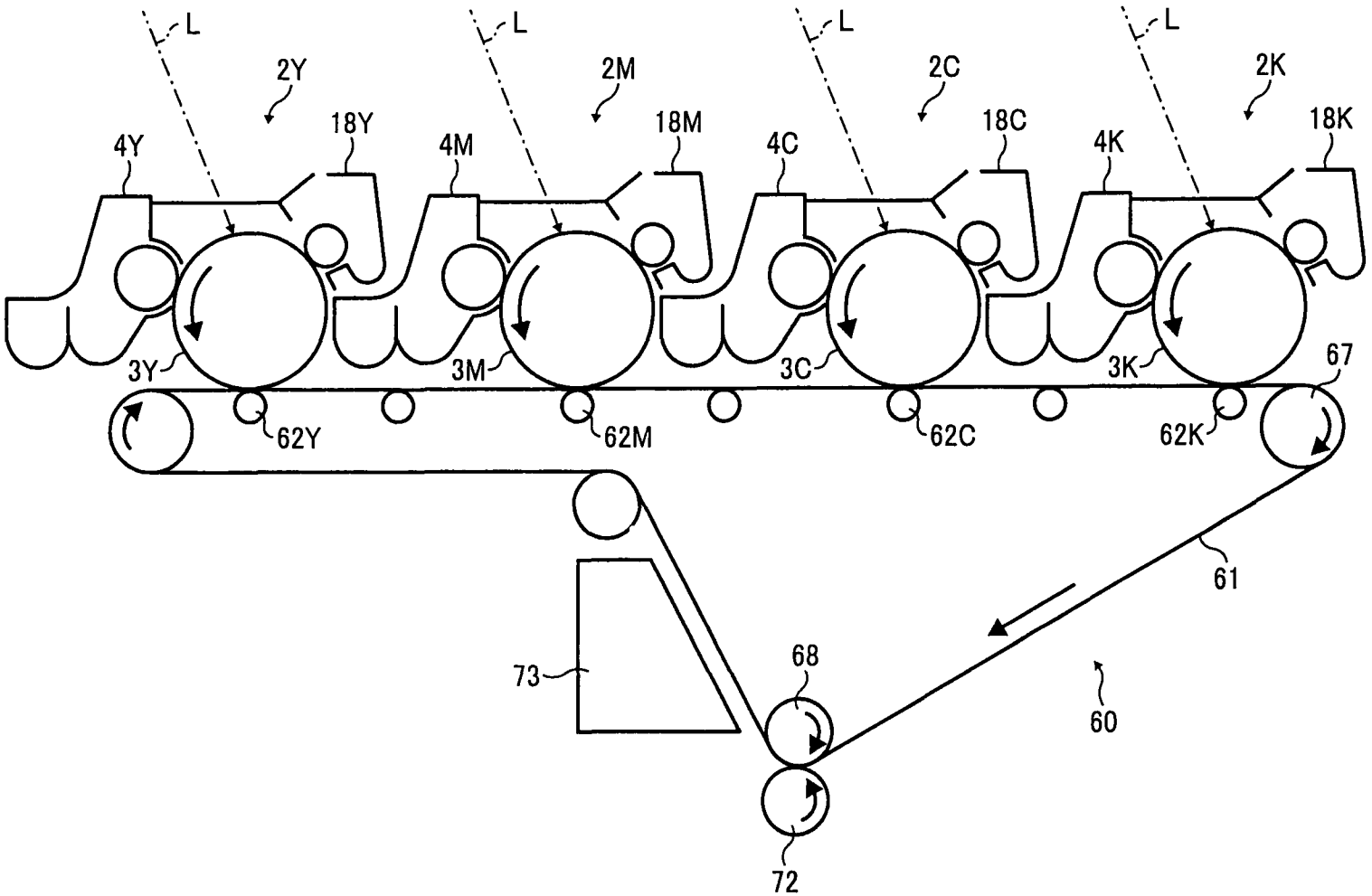
FIG. 2 is a partially enlarged view of an internal configuration of a printer in the copy machine.

FIG. 2 is a partially enlarged view of an internal configuration of the printer 1 in FIG. 1. Each of the process units 2Y, 2M, 2C, and 2K includes a photosensitive element being a latent-image carrier and various devices arranged around the photosensitive element which are set as one unit commonly supported by a support element. The unit is detachably attached to the main body of the printer 1. The units are identically configured except for different colors of the toner. The process unit 2Y for Y, as an example, includes the photosensitive element 3Y and a developing device 4Y that develops the electrostatic latent image formed on the surface thereof to a Y toner image. The copy machine is configured in a so-called "tandem" manner to align the four process units 2Y, 2M, 2C, and 2K facing an intermediate transfer belt 61 explained later along its endless movement direction.

Figure 3:
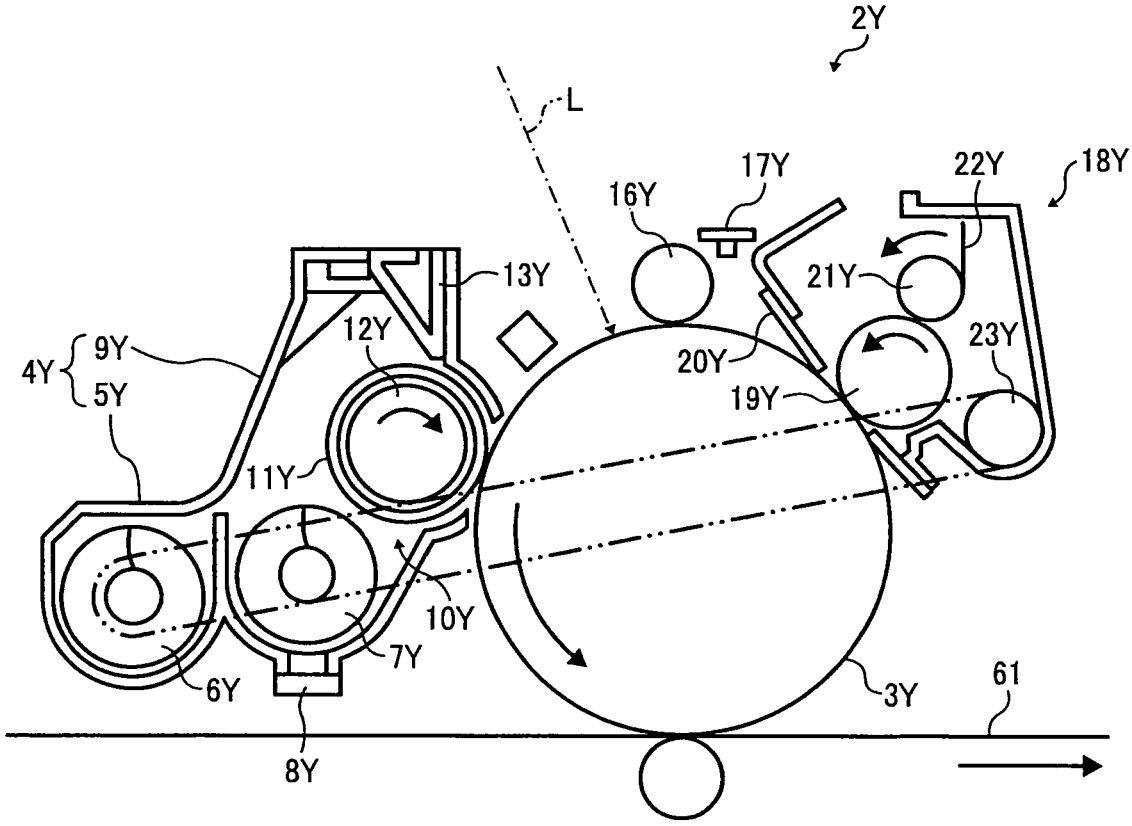
FIG. 3 is a schematic diagram of a process unit for Y in the printer.

FIG. 3 is an enlarged view of the process unit 2Y for Y. The process unit 2Y includes the developing device 4Y, a drum cleaning device 18Y, a neutralizing lamp 17Y, and a charging roller 16Y which are arranged around the photosensitive element 3Y.

Used as the photosensitive element 3Y is a drum-shaped one with a photosensitive layer formed thereon by applying an organic photosensitive material having photosensitivity, to an element tube made of aluminum or the like. However, an endless belt-shaped one can also be used.

The developing device 4Y develops a latent image using a two-component developer (hereinafter, "developer") containing magnetic carrier and nonmagnetic Y toner (not shown). The developing device 4Y includes a stirring unit 5Y that conveys the developer contained inside the device while stirring it, and a developing unit 9Y that develops the electrostatic latent image on the photosensitive element 3Y. As the developing device 4Y, any type that develops the image using a one-component developer not containing the magnetic carrier instead of the two-component developer can be used.

The stirring unit 5Y is provided in a position lower than the developing unit 9Y, and includes a first conveyor screw 6Y and a second conveyor screw 7Y which are arranged in parallel to each other, a partition plate provided between the screws, and a toner concentration sensor 8Y provided in the bottom of a casing.

The developing unit 9Y includes a developing roller 10Y opposed to the photosensitive element 3Y through an opening of the casing, and a doctor blade 13Y whose edge is made close to the developing roller 10Y. The developing roller 10Y includes a cylindrical developing sleeve 11Y formed with a nonmagnetic material, and a magnet roller 12Y non-rotatably provided inside the developing sleeve 11Y. The magnet roller 12Y has a plurality of magnetic poles arranged in its circumferential direction. These magnetic poles cause magnetic force to act on the developer on the sleeve at predetermined positions in the rotational direction. Thus, the developer sent from the stirring unit 5Y is attracted to the surface of the developing sleeve 11Y to be carried thereon and a magnetic brush is formed along the line of magnetic force on the surface of the sleeve.

The magnetic brush is controlled to an appropriate layer thickness when passing through an opposed position to the doctor blade 13Y following rotation of the developing sleeve 11Y, and then, is conveyed to a developing region opposed to the photosensitive element 3Y. The Y toner is transferred to the electrostatic latent image by a developing bias applied to the developing sleeve 11Y and by a potential difference with the electrostatic latent image on the photosensitive element 3Y, so that development is performed. Furthermore, the Y toner returns again into the developing unit 9Y following rotation of the developing sleeve 11Y, is separated from the surface of the sleeve due to effect of a repelling magnetic field formed between the magnetic poles of the magnet roller 12Y, and then is returned into the stirring unit 5Y. An appropriate amount of toner is supplied to the developer in the stirring unit 5Y based on the result of detection by the toner concentration sensor 8Y.

Used as the drum cleaning device 18Y is a system of pressing a polyurethane-rubber cleaning blade 20Y against the photosensitive element 3Y; however, any other system can be used. To enhance the cleaning performance, a system for providing a fur brush 19Y is employed in the copy machine. Specifically, the fur brush 19Y whose outer circumferential surface is brought into contact with the photosensitive element 3Y is provided so as to be rotatable in the arrow direction of FIG. 3. The fur brush 19Y plays also a role of scraping a lubricant from a solid lubricant (not shown) and powdering it to be applied to the surface of the photosensitive element 3Y.

The toner adhering to the fur brush 19Y is transferred to an electric-field roller 21Y that is in contact with the fur brush 19Y in the counter direction and is applied with bias while rotating. The toner scraped off from the electric-field roller 21Y by a scraper 22Y drops on a collecting screw 23Y.

The collecting screw 23Y conveys the collected toner toward an end portion in a direction perpendicular to the plane of FIG. 3 in the drum cleaning device 18Y, and transfers the collected toner to an external recycle conveying device. The recycle conveying device (not shown) sends the received toner to the developing device 4Y, where it is recycled.

The neutralizing lamp 17Y neutralizes the photosensitive element 3Y by light irradiation. The neutralized surface of the photosensitive element 3Y is uniformly charged by the charging roller 16Y, and then is optically scanned by the optical writing unit. It is noted that the charging roller 16Y is driven to rotate while being supplied with charging bias from a power supply (not shown). Instead of a charging system using the charging roller 16Y, a scorotron charger system can be used. The scorotron charger system performs a charging process in a non-contact manner with respect to the photosensitive element 3Y.

Referring back to FIG. 2, Y, M, C, and K toner images are formed on the surfaces of the photosensitive elements 3Y, 3M, 3C, and 3K, respectively, by the processes explained so far.

The transfer unit 60 is provided below the process units 2Y, 2M, 2C, and 2K. The transfer unit 60 endlessly moves the intermediate transfer belt 61 being an image carrier, which is stretched and supported by a plurality of rollers, by rotation of a driving roller 67 in the clockwise in FIG. 2 while being in contact with the photosensitive elements 3Y, 3M, 3C, and 3K. Thus, primary transfer nips for Y, M, C, and K are formed at portions where the photosensitive elements 3Y, 3M, 3C, and 3K are in contact with the intermediate transfer belt 61, respectively.

The intermediate transfer belt 61 is pressed against the photosensitive elements 3Y, 3M, 3C, and 3K by primary transfer rollers 62Y, 62M, 62C, and 62K arranged inside a belt loop near the primary transfer nips for Y, M, C, and K, respectively. Primary transfer biases are applied to the primary transfer rollers 62Y, 62M, 62C, and 62K by power supplies (not shown), respectively. Thus, primary-transfer electric fields are formed at the primary transfer nips for Y, M, C, and K so as to electrostatically move the toner images on the photosensitive elements 3Y, 3M, 3C, and 3K toward the intermediate transfer belt 61.

The intermediate transfer belt 61 sequentially passes through the primary transfer nips for Y, M, C, and K in association with the endless movement in the clockwise of FIG. 2, and the toner images are primarily transferred to the face of the intermediate transfer belt 61 at the primary transfer nips so as to be sequentially superimposed on each other. Four-color superimposed toner images (hereinafter, "four-color toner images") are formed on the face of the intermediate transfer belt 61 by the primary transfer in the superimposed manner.

A secondary transfer roller 72 being a rotator is provided in the lower part of the intermediate transfer belt 61 in FIG. 2. The secondary transfer roller 72 is in contact with a portion of the face of the intermediate transfer belt 61 that is wound around a transfer opposing roller 68, to form the secondary transfer nip. In other words, the secondary transfer nip is formed at the portion where the face of the intermediate transfer belt 61 and the secondary transfer roller 72 are in contact with each other.

A secondary transfer bias is applied to either one of the transfer opposing roller 68 inside the belt loop and the secondary transfer roller 72 outside the belt loop by the power supply (not shown). Meanwhile, the other one is electrically grounded. Thus, a secondary-transfer electric field is formed in the secondary transfer nip.

Although not shown in FIG. 2, the registration rollers 37 (in FIG. 1) are provided on the right side of the secondary transfer nip in FIG. 2. A recording sheet held by the rollers is sent to the secondary transfer nip at a timing so that the recording sheet can be synchronized with the four-color toner images on the intermediate transfer belt 61. In the secondary transfer nip, the four-color toner images on the intermediate transfer belt 61 are secondarily transferred to the recording sheet collectively due to the effect of the secondary-transfer electric field and of nip pressure, and become a full color image together with white of the recording sheet.

"Residual toner after transfer", which is not transferred to the recording sheet at the secondary transfer nip, adheres to the face of the intermediate transfer belt 61 having passed through the secondary transfer nip. The residual toner after transfer is cleaned by a belt cleaning device 73 that comes in contact with the intermediate transfer belt 61.

Referring back to FIG. 1, the recording sheet having passed through the secondary transfer nip separates from the intermediate transfer belt 61, and is transferred to the conveyor belt unit 39. The conveyor belt unit 39 endlessly moves an endless conveyor belt 40 in the counterclockwise in FIG. 1 by rotation of a driving roller 41 while the endless conveyor belt 40 is stretched and supported by the driving roller 41 and a driven roller 42. The conveyor belt 40 conveys the recording sheet received from the secondary transfer nip in association with the endless movement of the belt while holding it on the upper stretch face of the belt, and transfers the recording sheet to the fixing unit 43.

The fixing unit 43 endlessly moves a fixing belt 44, which is stretched and supported by a driving roller and a heating roller containing a heater, in the clockwise of FIG. 1 in association with rotation of the driving roller. A fixing nip is formed by causing a pressing roller 45 provided in the lower part of the fixing belt 44 to come in contact with the stretch face of the fixing belt 44 at its lower part. The recording sheet received by the fixing unit 43 is pressed and heated in the fixing nip, and the full color image is thereby fixed on the surface of the recording sheet. The recording sheet is sent out from the fixing unit 43 toward the switching claw 49.

The switching claw 49 is rotated by a solenoid (not shown), and a conveying path of the recording sheet is switched between a sheet discharging path and a switch-back path according to the rotation. When the sheet discharging path is selected by the switching claw 49, the recording sheet sent from the fixing unit 43 is discharged to the outside of the machine after passing through the sheet discharging path and the sheet-discharging rollers 47, and is stacked on the sheet discharging tray 48.

The switch-back device 46 is provided below the fixing unit 43 and the conveyor belt unit 39. When the switch-back path is selected by the switching claw 49, the recording sheet output from the fixing unit 43 passes through the switch-back path where the recording sheet is turned upside down, and is then sent to the switch-back device 46. The recording sheet again enters the secondary transfer nip, where a secondary transfer process and a fixing process of an image are subjected to the other side of the recording sheet.

The scanner 160 fixed on the printer 1 includes a fixed reader 161 and a moving reader 162 as reading units to read an image of an original (not shown). The fixed reader 161 includes a light source, a reflective mirror, and an image reading sensor such as a charge-coupled device (CCD), and is provided right under a first exposure glass (not shown) fixed to the upper wall of the casing of the scanner 160 so as to contact the original. When the original fed by the ADF 170 is passing on the first exposure glass, the light emitted from the light source is sequentially reflected on the surface of the original and is received by the image reading sensor through a plurality of reflective mirrors. Thus, the original is scanned without moving an optical system including the light source and the reflective mirrors.

Meanwhile, the moving reader 162 is provided right under a second exposure glass (not shown) fixed to the upper wall of the casing of the scanner 160 so as to be in contact with the original, and enables an optical system including a light source and reflective mirrors to move in the horizontal direction of FIG. 1. During the process of moving the optical system from the left side to the right side in FIG. 1, the light emitted from the light source is reflected by the original set on the second exposure glass, and is received by the image reading sensor fixed to the main body of the scanner through a plurality of reflective mirrors. Thus, the original is scanned while the optical system is moved.

Figure 4:
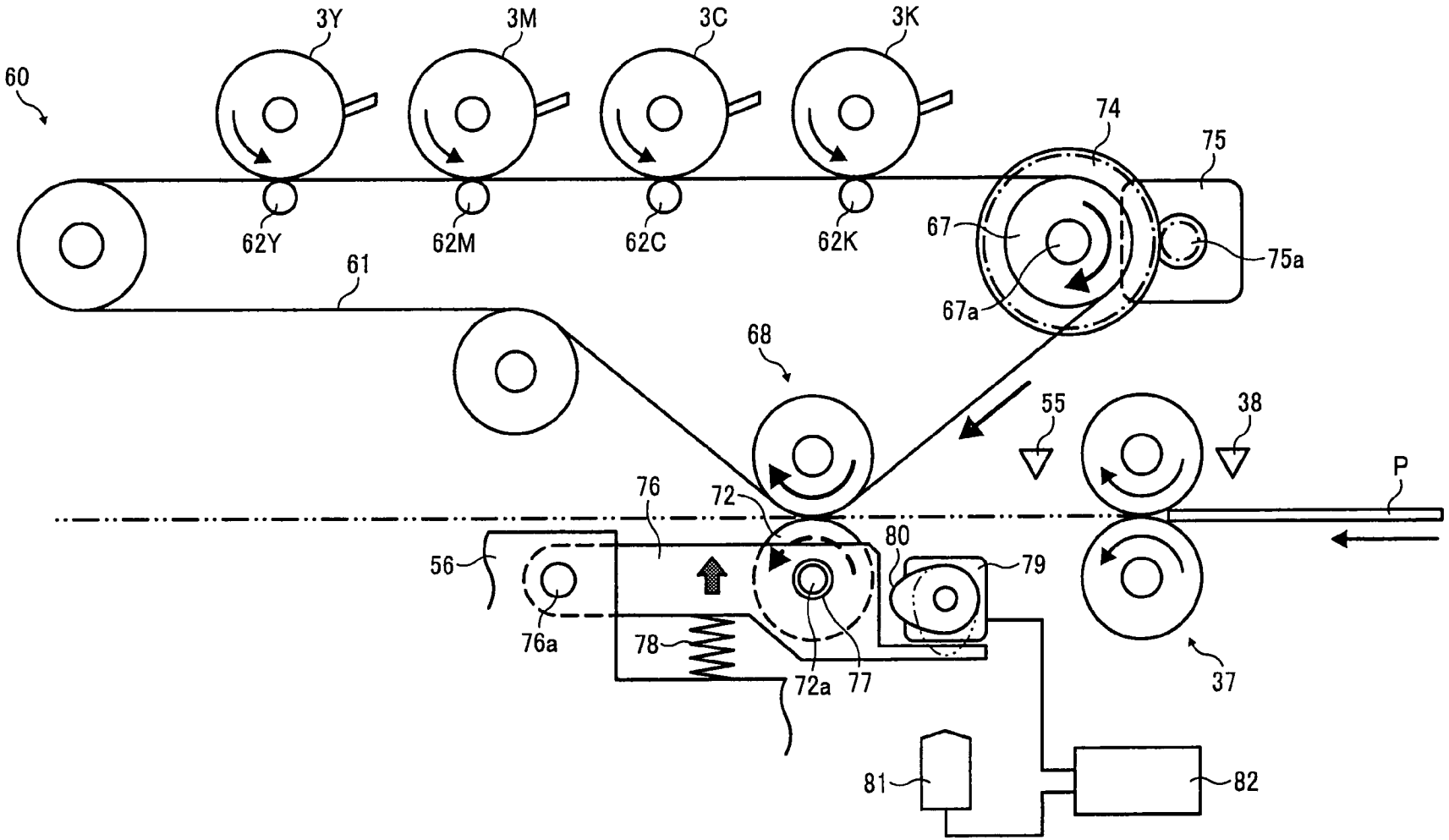
FIG. 4 is a schematic diagram of a transfer unit and its peripheral configuration in the copy machine.

FIG. 4 is a schematic diagram of the transfer unit 60 and its peripheral configuration. A drive receiving gear 74 is fixed to a rotating shaft element 67*a* of the driving roller 67 that endlessly moves the intermediate transfer belt 61 while stretching and supporting the belt. The drive receiving gear 74 is engaged with an output gear 75*a* fixed to a rotating shaft of a belt driving motor 75. The rotational drive force of the output gear 75*a* is transmitted to the intermediate transfer belt 61 through the drive receiving gear 74 and the driving roller 67.

Figure 5:
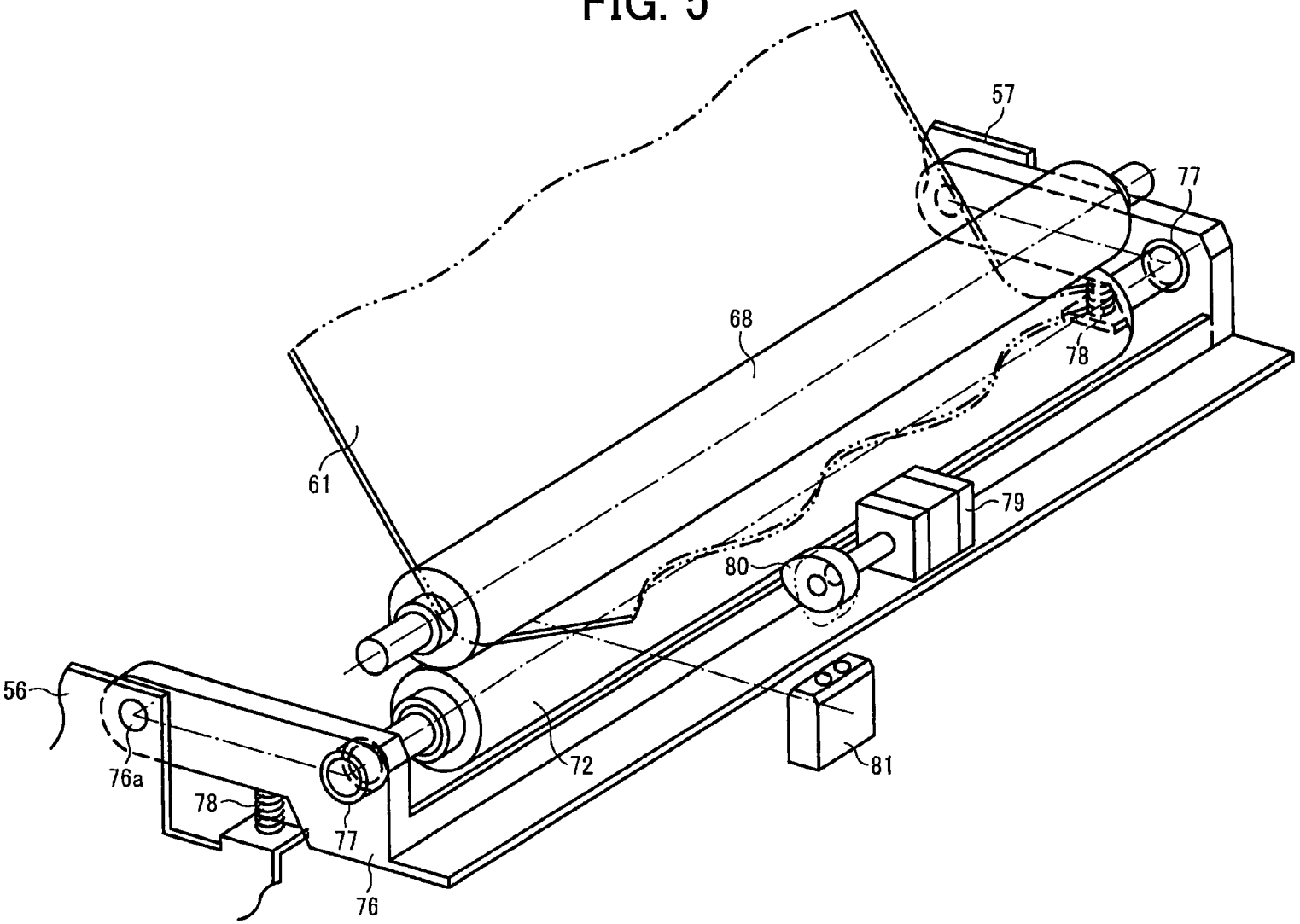
FIG. 5 is a perspective view of a secondary transfer nip and its peripheral configuration in the copy machine.

FIG. 5 is a perspective view of the secondary transfer nip and its peripheral configuration. The secondary transfer roller 72 being a rotator is in contact with a portion of the intermediate transfer belt 61 that is wound around the transfer opposing roller 68, to form the secondary transfer nip. The secondary transfer roller 72 is rotatably borne by a bearing 77 fixed to a swing arm 76 as a holder. The secondary transfer roller 72 and the transfer opposing roller 68 are provided in such a manner that their axial directions are along a front-back direction of the copy machine. The printer of the copy machine includes a front-supporting side plate 56 and a rear-supporting side plate 57 that are opposed to each other at a predetermined distance in the front-back direction (axial direction of the rollers) of the copy machine, and the swing arm 76 is located between these supporting side plates. A swing shaft 76*a* is provided so as to penetrate the supporting side plates, and the swing arm 76 is swingably supported around the swing shaft 76*a*.

One ends of biasing coil springs 78 being a biasing unit are fixed to the front-supporting side plate 56 and the rear-supporting side plate 57. The other ends of the biasing coil springs 78 are fixed to lower surfaces of the swing arm 76, respectively. Thus, the rotational force in the counterclockwise in FIG. 5 around the swing shaft 76*a* is given to the swing arm 76.

A portion of the intermediate transfer belt 61 that is wound around the transfer opposing roller 68 is positioned in the downstream side of the swing arm 76 in the rotational direction. Specifically, the swing arm 76 and the secondary transfer roller 72 held thereby are biased by the biasing coil springs 78 toward the intermediate transfer belt 61 being the image carrier. The biasing allows the secondary transfer roller 72 to come in contact with the portion of the intermediate transfer belt 61 that is wound around the transfer opposing roller 68, so that the secondary transfer nip is formed.

Because the swing arm 76 swings around the swing shaft 76*a* in the above manner, the secondary transfer roller 72 held by the swing arm 76 swings in a predetermined swing radius (hereinafter, "roller swing radius") around the swing shaft 76*a*. A cam motor 79 is opposed to the secondary transfer roller 72 at a portion of the swing arm 76 that swings in a swing radius larger than the roller swing radius. The cam motor 79 is supported by a support bracket (not shown) provided in the printer. An eccentric cam 80 is fixed to the rotating shaft of the cam motor 79. In the state as shown in FIG. 5, the rotating shaft of the cam motor 79 stops at a rotation angle so that the eccentric cam 80 is extended in the nine-o'clock direction in FIG. 5. When the rotating shaft starts rotating by the drive of the cam motor 79 from this state in the counterclockwise in FIG. 5, the eccentric cam 80 starts pressing against the swing arm 76, as shown in FIG. 6, and starts depressing the swing arm 76 against the biasing force of the biasing coil spring 78.

Figure 6:
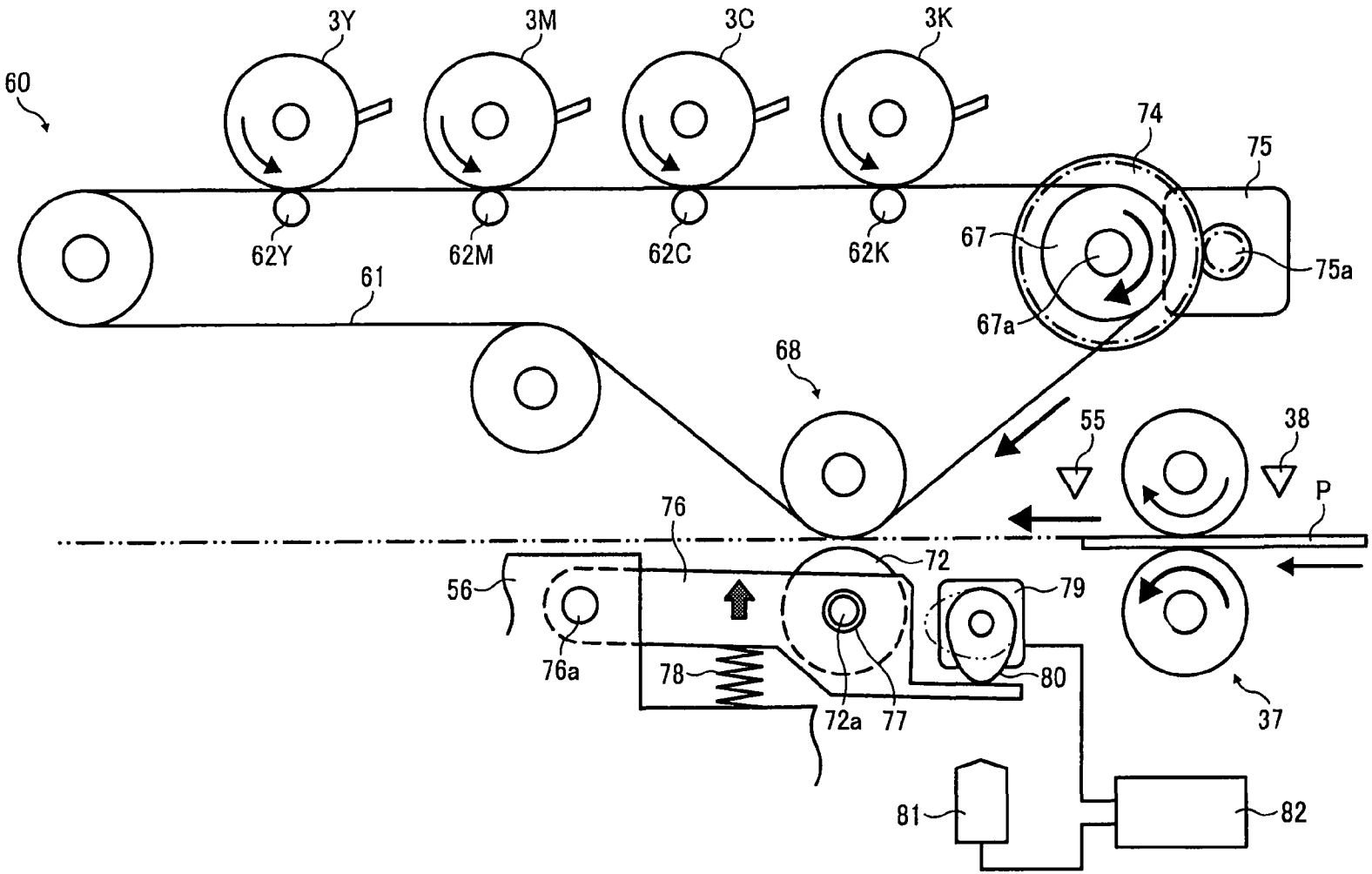
FIG. 6 is a schematic diagram of the secondary transfer nip and the peripheral configuration when a swing arm is depressed by an eccentric cam.

Arranged in the right side of the secondary transfer nip in FIG. 6 are the registration rollers 37 for feeding a recording sheet P toward the secondary transfer nip. Arranged near the registration rollers 37 are a registration sensor 55 and a thickness sensor 38 being a thickness-information acquiring unit.

The thickness sensor 38 detects a thickness of the recording sheet P to be fed into the registration rollers 37, and outputs the result of detection to a controller 82 being a control unit. Furthermore, the controller 82 includes a central processing unit (CPU) being a computing unit (not shown), a random access memory (RAM) being a data storage unit, and a read only memory (ROM) being a data storage unit. The controller 82 controls the drive of various devices of the copy machine and sets operating conditions.

Any other sensor can be used as the thickness sensor 38 if it detects a thickness of the recording sheet P based on a displacement between rollers when the recording sheet P is held between the registration rollers 37 or if it detects a thickness of the recording sheet P based on a distance between the sensor and the surface of the recording sheet P.

The registration sensor 55 is formed with a reflection type photosensor or the like, and detects the leading edge of the recording sheet P having passed through the registration rollers 37 and outputs a detection signal to the controller 82. The controller 82 temporarily stops driving the registration rollers 37 based on the detection signal, and causes the recording sheet P to be in a standby state at the position of the registration rollers 37.

The copy machine according to the first embodiment uses a roller, as the secondary transfer roller 72, with lower hardness than that of the transfer opposing roller 68. By bringing the secondary transfer roller 72 into contact with the transfer opposing roller 68 through the intermediate transfer belt 61, the roller portion of the secondary transfer roller 72 formed with the elastic element is deformed, and the secondary transfer nip with a certain length in the rotational direction of the roller is formed. If both the secondary transfer roller 72 and the transfer opposing roller 68 are formed with an undeformable metal roller, the secondary transfer nip cannot be formed, and the secondary transfer roller 72 is caused to be in a linear contact with the intermediate transfer belt 61. Assuming that an inter-shaft distance between the secondary transfer roller 72 and the transfer opposing roller 68 upon occurrence of the linear contact is L1, an inter-shaft distance L2, when the secondary transfer nip as formed in the copy machine according to the first embodiment is formed, becomes shorter than L1. A value obtained by subtracting the inter-shaft distance L2 from the inter-shaft distance L1 is a contact depth of the transfer opposing roller 68 into the secondary transfer roller 72.

The copy machine according to the first embodiment provides three modes of plain paper mode, cardboard mode, and paperboard mode as image-forming operation modes to form an image on the recording sheet P. The plain paper mode is used when the recording sheet P has a thickness of less than 200 micrometers. In the plain paper mode, by stopping the rotating shaft of the cam motor 79 when the eccentric cam 80 is extended in the nine-o'clock direction in FIG. 4, the image forming operation is performed without pressing the eccentric cam 80 against the swing arm 76. A contact depth of the transfer opposing roller 68 into the secondary transfer roller 72 in the plain paper mode is 0.5 millimeters.

The cardboard mode is used when the recording sheet P has a thickness of 200 micrometers or more to less than 400 micrometers. In the cardboard mode, the eccentric cam 80 depresses the swing arm 76 to a position so that a contact depth of the transfer opposing roller 68 into the secondary transfer roller 72 is set to nearly 0.2 millimeters, and then, an image forming operation is performed.

The paperboard mode is used when the recording sheet P has a thickness of 400 micrometers or more. In the paperboard mode, a contact depth of the transfer opposing roller 68 into the secondary transfer roller 72 is set to nearly 0 millimeter, and the eccentric cam 80 depresses the swing arm 76 to a position where the secondary transfer roller 72 is caused to lightly touch the intermediate transfer belt 61, and then, an image forming operation is performed.

It is noted that any other mode may be provided. In this mode, the eccentric cam 80 depresses the swing arm 76 to a position where the secondary transfer roller 72 is separated from the intermediate transfer belt 61 so as to form a predetermined gap therebetween, and then, an image forming operation is performed.

The copy machine with the basic configuration is provided with a visible-image forming unit that includes the process units 2Y, 2M, 2C, and 2K, the optical writing unit 50, and the transfer unit 60 and that forms toner images being visible images on the surface of the intermediate transfer belt 61 as the image carrier. Furthermore, the transfer unit 60 functions as a transfer unit that transfers the toner images formed on the surface of the intermediate transfer belt 61 to the recording sheet.

Next, a characteristic configuration of the copy machine according to the first embodiment will be explained below.

A distance sensor 81 being a position detector is provided below the swing arm 76 and at a location opposed to the eccentric cam 80 through the swing arm 76. The distance sensor 81 detects a distance between the sensor and an object to be detected while emitting ultrasonic wave, infrared ray, magnetism, or the like, and outputs the result of detection to the controller 82. The controller 82 obtains a distance between the intermediate transfer belt 61 and the rotating shaft of the secondary transfer roller 72 and also obtains a position of the rotating shaft of the secondary transfer roller 72 in the machine based on the result of detection by the distance sensor 81.

More specifically, the controller 82 obtains a distance between a portion on the surface of the intermediate transfer belt 61 with which the secondary transfer roller 72 comes in the strongest contact and the rotating shaft of the secondary transfer roller 72 (hereinafter, "belt-shaft distance"), and also obtains a position of the rotating shaft. The portion on the surface of the intermediate transfer belt 61 with which the secondary transfer roller 72 comes in the strongest contact is a portion that intersects a straight line connecting between the center of the rotating shaft of the transfer opposing roller 68 and the center of the rotating shaft of the secondary transfer roller 72.

As shown in FIG. 6, the distance sensor 81 detects a portion of the swing arm 76 depressed by the eccentric cam 80 as an object to be detected. The depressed portion is where a swing radius around the swing shaft 76*a* becomes larger than that of the secondary transfer roller 72. Consequently, when the eccentric cam 80 depresses the swing arm 76 to move the secondary transfer roller 72 by a distance La, the depressed portion being the object to be detected by the distance sensor 81 becomes a distance La' that is larger than the distance La. A ratio of the distance La to the distance La' is constant, and thus the controller 82 can obtain the distance La by the distance La' based on the result of detection by the distance sensor 81. Resultantly, the distance La is detected using the distance La' being an amplified distance La, and therefore, a moving amount of the secondary transfer roller 72 can be detected with high precision as compared with the case where the distance La is detected as it is or the distance La is reduced for detection.

Figure 7:
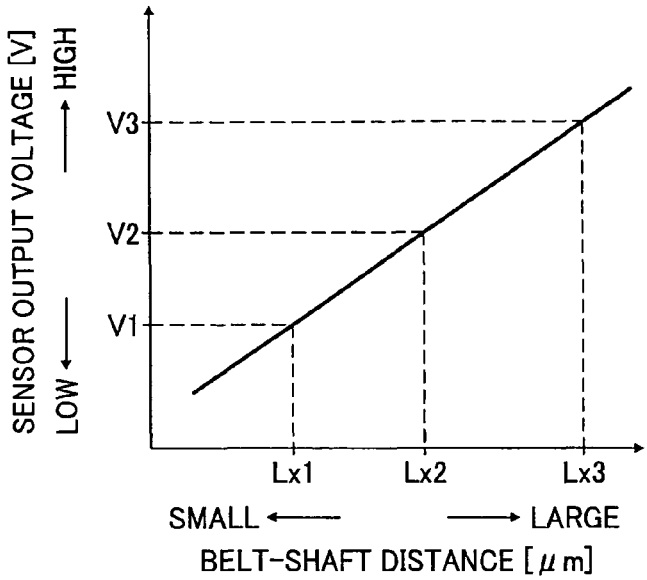
FIG. 7 is a graph representing a relationship between an output voltage from a distance sensor and a belt-shaft distance in the copy machine.

FIG. 7 is a graph representing a relationship between an output voltage from the distance sensor 81 and the belt-shaft distance. The controller 82 stores algorithm corresponding to the graph or a data table corresponding to the graph in the ROM (not shown) in advance. The distance sensor 81 used in the copy machine is such that an output voltage is increased with a decrease in distance between an object to be detected (the depressed portion) and the own sensor. When the secondary transfer roller 72 is moved away from the intermediate transfer belt 61 due to the depression of the swing arm 76 by the eccentric cam 80, the belt-shaft distance further increases, and the secondary transfer nip pressure further decreases.

At this time, because the distance between the distance sensor 81 and the depressed portion further decreases, an output voltage of the distance sensor 81 increases. Specifically, in the copy machine, when the swing arm 76 is depressed by the eccentric cam 80 (when the belt-shaft distance increases), the output voltage of the distance sensor 81 increases according to an amount of the depression.

Figure 8:
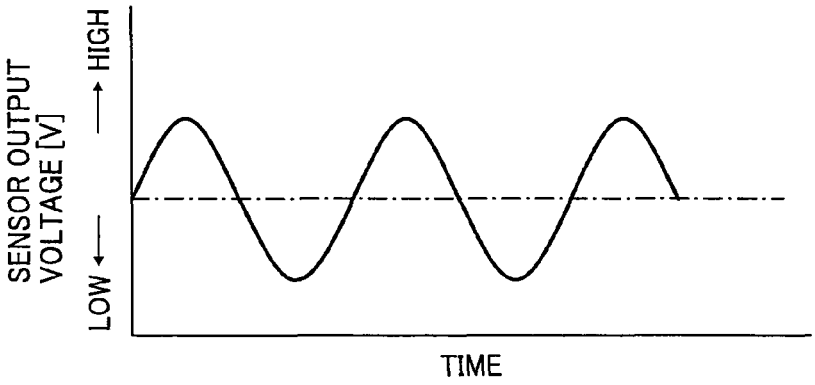
FIG. 8 is a graph representing fluctuation curve of an output voltage from the distance sensor at a sheet non-passing time in a plain sheet mode.

FIG. 8 is a graph representing fluctuation of an output voltage of the distance sensor 81 at a sheet non-passing time (when the recording sheet is not fed into the nip) in the plain paper mode. As explained above, in the plain paper mode, because the eccentric cam 80 is not pressed against the swing arm 76, the depressed portion of the swing arm 76 is set to a position where a predetermined transfer nip pressure is obtained under the condition of a diameter of the secondary transfer roller 72 at that time. The reason why a relationship between the output voltage and the time has a sine-curve characteristic as shown in FIG. 8 is because the belt-shaft distance changes depending on a rotation angle of the secondary transfer roller 72 caused by eccentricity of the secondary transfer roller 72. A portion in the upper side of the central line in the sine curve indicates that a portion of a circumferential surface of the secondary transfer roller 72 that rotates in a larger radius than a radius of normal rotation enters the transfer nip.

Figure 9:
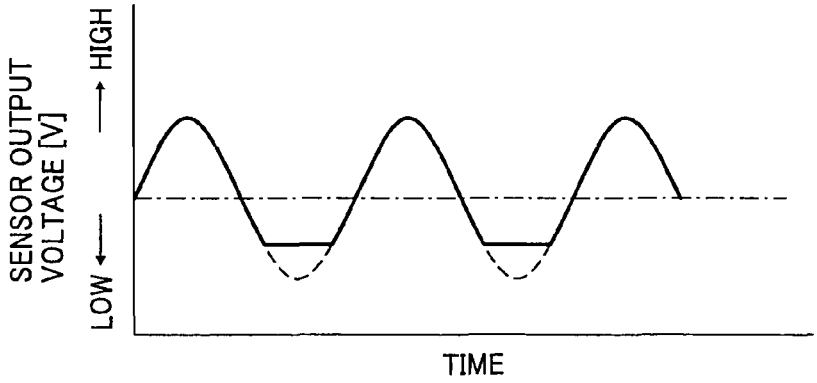
FIG. 9 is a graph representing the fluctuation curve when a contact line starts appearing.

As shown in FIG. 9, when the eccentric cam 80 is caused to rotate a little, instead of a portion lower than the central line in the sine curve that is partially eliminated, a horizontal line appears in a portion of the graph corresponding to the eliminated portion. This is because when a small diameter region of the secondary transfer roller 72 enters the secondary transfer nip and the swing arm 76 is about to move toward the intermediate transfer belt 61, the swing arm 76 comes in contact with the eccentric cam 80 at a time when it moves up to a certain position. The horizontal line corresponds to a contact position between the eccentric cam 80 and the swing arm 76. Hereinafter, the horizontal line is called "contact line".

Figure 10:
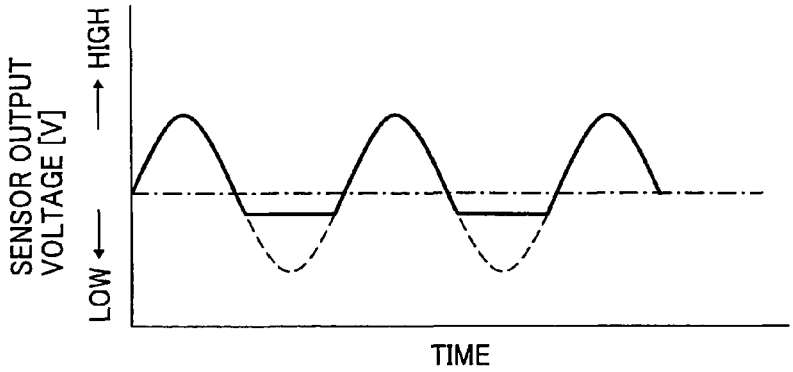
FIG. 10 is a graph representing the fluctuation curve when the contact line shifts upward higher than that of FIG. 9.

As shown in FIG. 10, when the eccentric cam 80 is caused to rotate little further, the position of the "contact line" shifts slightly upward. This is because the contact position between the eccentric cam 80 and the swing arm 76 shifts to the side of the biasing coil spring 78.

Figure 11:
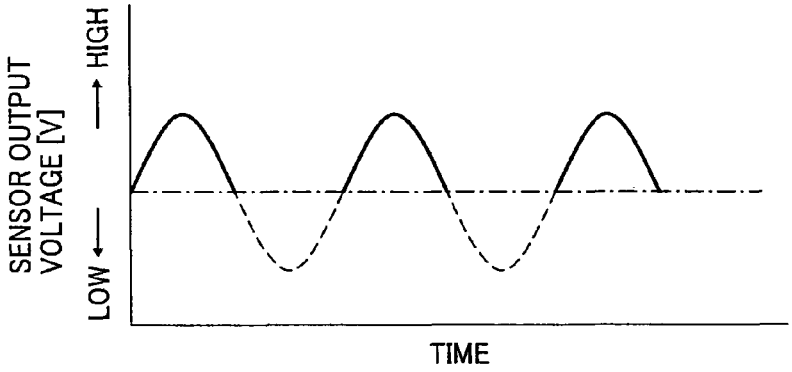
FIG. 11 is a graph representing the fluctuation curve when the contact line shifts up to a balanced position.

As shown in FIG. 11, when the eccentric cam 80 is caused to rotate further more, the position of the "contact line" shifts up to a position of a central value of the sine curve. This indicates that the contact position between the eccentric cam 80 and the swing arm 76 reaches a following position. Specifically, the contact position is a position where an appropriate transfer nip pressure works in a state in which a portion of the circumferential surface of the roller that rotates in a normal radius of rotation is caused to enter the secondary transfer nip. Hereinafter, this position is called "normal radius position".

Referring back to FIG. 7, an output voltage V1 indicates that the swing arm 76 is in this "normal radius position" (belt-shaft distance=L×1). An output voltage V2 indicates that the swing arm 76 is in a position where the contact depth of the transfer opposing roller 68 into the secondary transfer roller 72 is set to 0.2 millimeters which corresponds to the cardboard mode (belt-shaft distance=L×2). An output voltage V3 indicates that the swing arm 76 is in a position where the contact depth of the transfer opposing roller 68 into the secondary transfer roller 72 is set to 0 millimeter which corresponds to the paperboard mode (belt-shaft distance=L×3).

Figure 12:
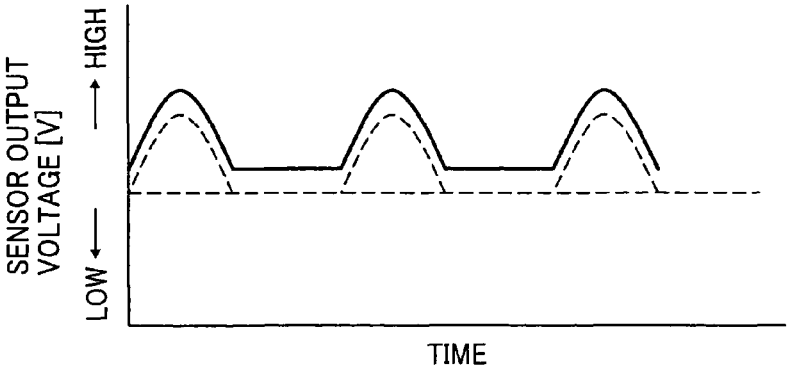
FIG. 12 is a graph representing the fluctuation curve when actual depression of the swing arm is started by the eccentric cam.

As shown in FIG. 12, when the eccentric cam 80 is caused to rotate still further, the "contact line" further shifts downward. At this time, however, the graph shows different behavior from that up to this time. More specifically, in FIGS. 9 to 11, even if the "contact line" shifts upward, the position of the upper half of the sine curve does not change. On the other hand, in FIG. 12, the "contact line" shifts upward, and in addition, the upper half of the sine curve also shifts upward by an amount of shift equal to the upward movement of the "contact line", as compared with that of FIG. 11.

The reason is as follows. That is, in the states in FIG. 9 to FIG. 11, the "contact line" appears caused by the contact between the eccentric cam 80 and the swing arm 76; however, the eccentric cam 80 does not actually depress the swing arm 76. The actual depression indicates that the eccentric cam 80 rotates up to an angle at which the eccentric cam 80 is always in contact with the swing arm 76 regardless of the rotation angle of the secondary transfer roller 72. Therefore, the swing arm 76 is actually depressed by the eccentric cam 80 only after the contact position between the two or the "contact line" is caused to shift up to the "normal radius position". In other words, after the "contact line" is caused to shift up to the "normal radius position", the actual depression of the swing arm 76 is started by the eccentric cam 80. Then, the upper half of the sine curve starts to move upward together with the "contact line".

Referring back to FIG. 8, the central value (central value of a wave height) of the sine curve indicates an average of distances between the surface of the intermediate transfer belt 61 and the rotating shaft of the secondary transfer roller 72 when the eccentric cam 80 is not pressed against the swing arm 76. When a diameter and an elastic modulus of the secondary transfer roller 72 change with a change in temperature, the position of the central value moves vertically according to the change, and each position at that time is an appropriate value at which an appropriate transfer nip pressure is obtained. When the eccentric cam 80 is not pressed against the swing arm 76, the distance between the surface of the intermediate transfer belt 61 and the rotating shaft of the secondary transfer roller 72 is spontaneously adjusted to the appropriate value in the above manner.

When the diameter and the elastic modulus of the secondary transfer roller 72 change with a change in temperature, the central value of the sine curve moves vertically according to the change. This means that, in FIG. 7, the position of V1 shifts up and down accordingly. If the positions of V2 and V3 are shifted up and down accordingly, then each distance between the belt surface and the rotating shaft of the secondary transfer roller 72 can also be set to a value (a distance in which an appropriate transfer nip can be obtained when the sheet is held by the nip) appropriate for the diameter and the elastic modulus of the secondary transfer roller 72 in the cardboard mode and the paperboard mode.

The controller 82 is, therefore, configured to perform the following process at periodic timing such as each passage of a predetermined time. Specifically, first, when the eccentric cam 80 is located at a home position where it is extended in the nine-o'clock direction in FIG. 6, the controller 82 samples output voltages from the distance sensor 81 for every integral number of rotations of the secondary transfer roller 72 at a predetermined time interval such as 20 milliseconds while causing the secondary transfer roller 72 to rotate one or more times, and stores sampled results in the RAM. With these operations, the controller 82 analyzes fluctuations in belt-shaft distances at every integral number of rotations of the secondary transfer roller 72. That is, the controller 82 executes an analysis process for analyzing the belt-shaft distances. This analysis enables an appropriate belt-shaft distance to be accurately obtained even if the secondary transfer roller 72 is decentered.

Next, the central value which divides an area of the sine curve into two parts is obtained using a known analysis method, and an output voltage from the distance sensor 81 corresponding to the central value is determined as an appropriate value in the plain paper mode. A shift amount from V1 in FIG. 7 in the appropriate value is obtained, and then V2 or V3 in FIG. 7 is caused to shift up and down by the shift amount. With this feature, a belt-shaft distance in the cardboard mode or the paperboard mode is corrected to a value appropriate for the diameter of the secondary transfer roller 72. Thereafter, when the cardboard mode or the paperboard mode is executed, the swing arm 76 is depressed to a position of V2 or V3.

A rotary encoder-based motor is used as the cam motor 79. The controller 82 can accurately obtain a rotation angle of the rotating shaft of the cam motor 79 based on a signal sent from the rotary encoder. There is shown an excellent relationship between a rotation angle of the rotating shaft of the cam motor 79 and a depressed position of the swing arm 76. The controller 82 stores the data table indicating a relationship between the rotation angle and the depressed position of the swing arm 76 (an output voltage in FIG. 7) in the ROM. The controller 82 specifies a rotation angle corresponding to V2 or V3 after being corrected from the data table, and rotates the cam motor 79 to a position at the rotation angle equal to the result of specification, to thereby depress the swing arm 76 to a target position.

The copy machine further includes a rotary encoder (not shown) being a rotation-angle detector that detects a rotation angle of the secondary transfer roller 72 provided near the rotating shaft of the secondary transfer roller 72. The controller 82 obtains which of the radius portions of the secondary transfer roller 72 is caused to enter the secondary transfer nip based on the result of detection by the rotary encoder.

For example, when an upper-side peak in the sine curve of FIG. 8 is obtained, this means that a maximum radius portion of the secondary transfer roller 72 enters the secondary transfer nip, and thus, the belt-shaft distance is the largest. Assuming that angle information (phase pulse) from the rotary encoder at this time is Pa, when the angle information from the rotary encoder becomes Pa, this indicates that the maximum radius portion of the secondary transfer roller 72 enters the secondary transfer nip. When the central value in the sine curve of FIG. 8 is obtained, the normal radius portion of the secondary transfer roller 72 enters the secondary transfer nip. Assuming that angle information obtained from the rotary encoder at this time is Pb, when the angle information obtained from the rotary encoder becomes Pb, this indicates that the normal radius portion of the secondary transfer roller 72 enters the secondary transfer nip.

Furthermore, when a lower-side peak in the sine curve of FIG. 8 is obtained, a minimum radius portion of the secondary transfer roller 72 enters the secondary transfer nip. Assuming that angle information obtained from the rotary encoder at this time is Pc, when the angle information from the rotary encoder becomes Pc, this indicates that the minimum radius portion of the secondary transfer roller 72 enters the secondary transfer nip. In this manner, the controller 82 can obtain which of the radius portions of the secondary transfer roller 72 is caused to enter the secondary transfer nip based on the result of detection by the rotary encoder.

When the swing arm 76 is to be depressed to the target position, the controller 82 first stops rotation of the secondary transfer roller 72 at timing when the result of detection by the rotary encoder becomes Vb as explained above. In other words, the rotation of the secondary transfer roller 72 is stopped in a state in which the normal radius portion of the secondary transfer roller 72 is caused to enter the secondary transfer nip. Thereafter, the swing arm 76 is depressed to the target position. Thus, setting is performed so that the belt-shaft distance becomes appropriate when the normal radius portion of the secondary transfer roller 72 is caused to enter the secondary transfer nip.

Thereafter, when a print job is performed based on image information, the controller 82 first loads data for fluctuation of the belt-shaft distance for every integral number of rotations of the secondary transfer roller 72, the data being acquired in advance in a state where the eccentric cam 80 is not pressed against the swing arm 76. Then, when starting rotation of the secondary transfer roller 72, the controller 82 changes each rotation angle of the eccentric cam 80 from moment to moment based on the data and an output value of the rotary encoder that detects the rotation angle of the secondary transfer roller 72. Specifically, the controller 82 changes the rotation angle of the eccentric cam 80 so as to fluctuate an amount of depression (contact amount) of the swing arm 76 by the eccentric cam 80 in an opposite phase to a phase of the sine curve in data for the fluctuation of the belt-shaft distance.

With this feature, the fluctuation of the belt-shaft distance due to eccentricity of the secondary transfer roller 72 as shown in the waveform representing change of a sensor output in FIG. 8 is counterbalanced with the fluctuation of the belt-shaft distance due to the change in the rotation angle of the eccentric cam 80 (change in the amount of depression). Therefore, by setting the belt-shaft distance to be constant regardless of the rotation angle of the secondary transfer roller 72, it is possible to prevent occurrence of shock jitter, in the printing job, due to entering of a cardboard or a paperboard into the secondary transfer nip at the timing when the belt-shaft distance becomes the minimum caused by eccentricity of the roller. It is also possible to prevent occurrence of transfer failure and image distortion due to fluctuation of the transfer nip pressure caused by fluctuation of the belt-shaft distance.

It is configured to provide the control to fluctuate the amount of depression in the opposite phase to the phase of the sine curve in the data for the fluctuation of the belt-shaft distance, also in the plain paper mode. Therefore, it is also possible, in the plain paper mode, to prevent transfer failure and image distortion due to fluctuation of the transfer nip pressure caused by the fluctuation of the belt-shaft distance.

A stepping motor can be used as the cam motor 79 instead of using the rotary encoder-based motor as the cam motor 79, to obtain the rotation angle of the cam motor 79 based on the number of step pulses for driving the stepping motor.

A correlation between the rotation angle of the rotating shaft of the cam motor 79 and the depressed position of the swing arm 76 becomes weaker as the eccentric cam 80 wears. To deal with this case, the cam motor 79 can be kept driven until the output voltage from the distance sensor 81 becomes V2 or V3 after being corrected.

In the copy machine configured in the above manner, even if the diameter and the elastic modulus of the secondary transfer roller 72 change in association with the change in temperature, the swing arm 76 can be depressed to each position appropriate for respective diameters in the cardboard mode and the paperboard mode. Thus, it is possible to minimize occurrence of shock jitter and transfer failure caused by the change in the diameter of the secondary transfer roller 72 in the cardboard mode and the paperboard mode.

Figure 13:
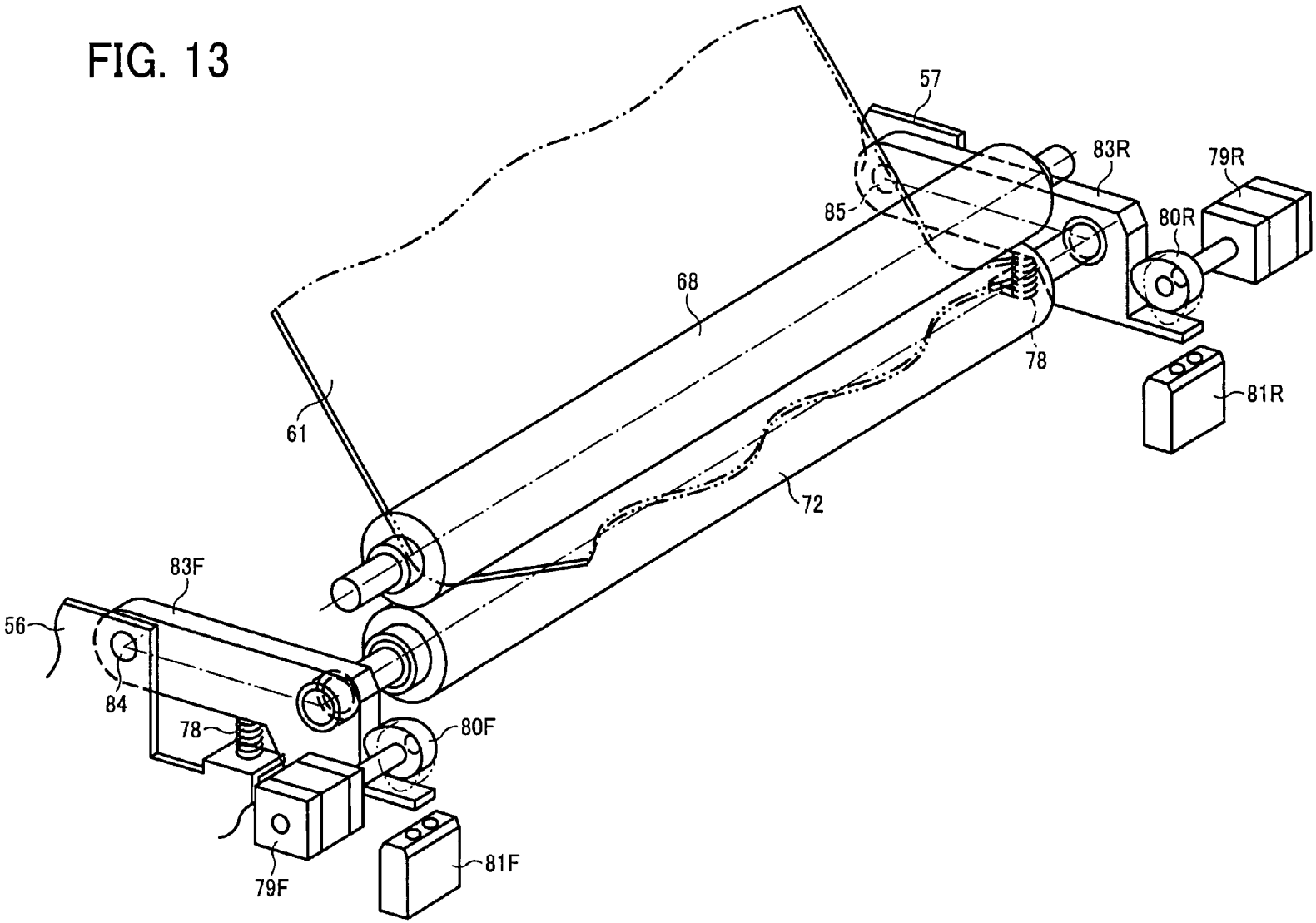
FIG. 13 is a perspective view of a secondary transfer nip and its peripheral configuration in a copy machine according to a modified example of the first embodiment of the present invention.

Next, a modified example of the first embodiment of the present invention will be explained below. FIG. 13 is a perspective view of the secondary transfer nip and its peripheral configuration in a copy machine according to the modified example. It is noted that the same numerals are assigned to components corresponding to these of the first embodiment.

In FIG. 13, the secondary transfer roller 72 has rotating shaft elements that protrude from both ends of the roller portion in the axial direction and are held by mutually different swing arms, respectively. Specifically, the front-supporting side plate 56 in the printer swingably supports a front swing arm 83F around a swing shaft 84. The front swing arm 83F rotatably holds the rotating shaft element in the front side of the secondary transfer roller 72. The rear-supporting side plate 57 in the printer swingably supports a rear swing arm 83R around a swing shaft 85. The rear swing arm 83R rotatably holds the rotating shaft element in the rear side of the secondary transfer roller 72.

The front swing arm 83F being a swing element is depressed by a front eccentric cam 80F that is driven to rotate by a front cam motor 79F. The belt-shaft distance in the front side of the secondary transfer roller 72 is obtained based on the result of detection by a front distance sensor 81F provided below the front swing arm 83F.

The rear swing arm 83R being a swing element is depressed by a rear eccentric cam 80R that is driven to rotate by a rear cam motor 79R. The belt-shaft distance in the rear side of the secondary transfer roller 72 is obtained based on the result of detection by a rear distance sensor 81R provided below the rear swing arm 83R.

Specifically, in the copy machine according to the modified example, one end side (front side) and the other end side (rear side) of the secondary transfer roller 72 in the rotating shaft direction include following components, respectively. That is, the components are the biasing coil spring 78 being a biasing unit, the eccentric cam (80F, 80R) being a pressing element, the cam motor (79F, 79R) being a moving unit, and the distance sensor (81F, 81R) being a position detector. The controller 82 discretely performs the same process as that of the copy machine according to the first embodiment on the front side and the rear side, to discretely adjust each belt-shaft distance in the front side and the rear side.

In the configuration, by adjusting each belt-shaft distance in the front side and the rear side to a value appropriate for the diameter of the secondary transfer roller 72 in the cardboard mode and the paperboard mode, the shock jitter and the transfer failure can be satisfactorily minimized in the front side and the rear side, respectively.

The copy machine configured to transfer the toner images on the intermediate transfer belt 61 to the recording sheet P held by the intermediate transfer belt 61 and the secondary transfer roller 72 is explained so far. However, the present invention is applicable to a configuration in which a visible image on the image carrier is transferred to the recording sheet P held by the secondary transfer roller and the drum-shaped image carrier. The present invention is also applicable to a configuration in which a visible image on the image carrier is transferred to the recording sheet held by the image carrier and the portion of a belt that is wound around a roller while the belt is stretched and supported by the roller being a rotator.

The example of using the thickness sensor 38 as the thickness-information acquiring unit is explained. However, an input unit, such as a numeric keypad that receives an input operation of thickness information by an operator, can be used as the thickness-information acquiring unit, so that image-formation operating modes can be switched based on the result of the input.

A second embodiment of the present invention is explained.

The present inventors have been dedicated to studying as explained below, to achieve the present invention based on the results of the study. Specifically, when a contact unit is forcibly moved beforehand by an eccentric cam, sharp load fluctuation on an image carrier upon entering or discharging of a sheet into or from a transfer nip can be reduced more as the moving amount (hereinafter, "forcible moving amount M1") is increased. However, if the forcible moving amount M1 is increased too much, this causes low transfer pressure. Therefore, the forcible moving amount M1 is kept to a threshold value at which required transfer pressure is obtained, and this enables to reduce the sharp load fluctuation on the image carrier as much as possible while preventing transfer failure.

Figure 15:
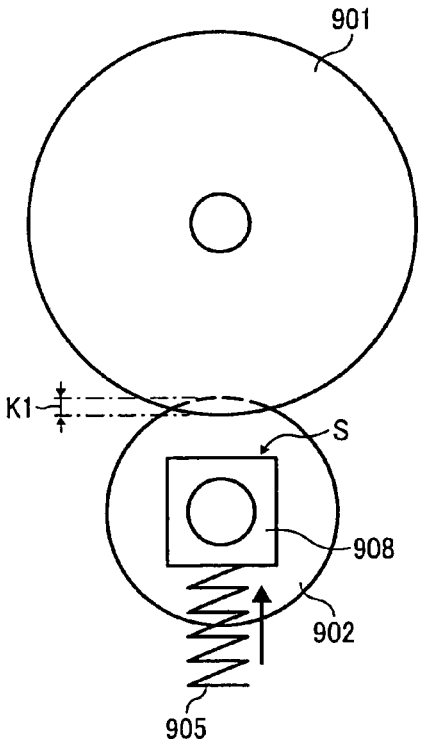
FIG. 15 is an enlarged view for explaining an example of a transfer nip.
Figure 16:
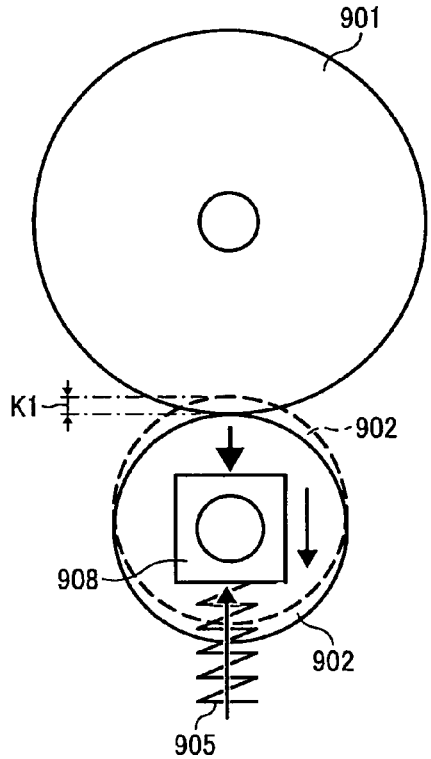
FIG. 16 is an enlarged view for explaining the transfer nip right before a contact unit separates from an image carrier shown in FIG. 15.
Figure 17:
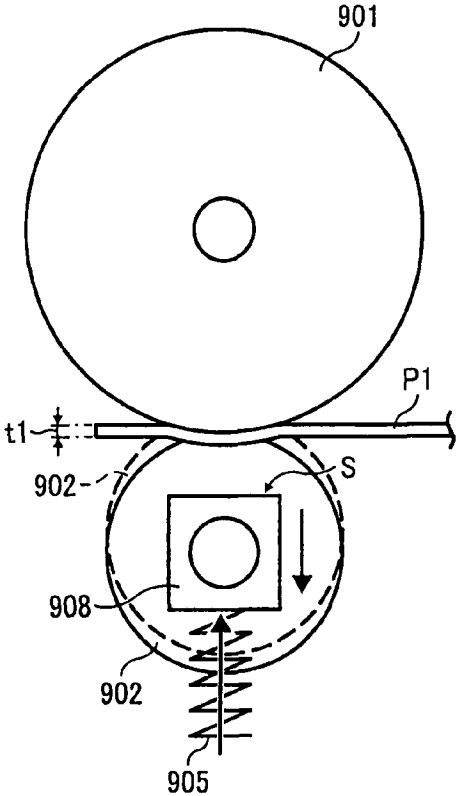
FIG. 17 is a schematic diagram for explaining natural movement of the contact unit when a recording sheet enters the transfer nip.

Referring back to FIG. 15, the contact unit 902 biased by the spring 905 is in direct contact with the image carrier 901. As shown in FIG. 17, while the contact unit 902 is not forcibly moved from this state, a cardboard P1 is caused to enter a nip between the image carrier 901 and the contact unit 902. Then, the contact unit 902 naturally moves downward following a thickness t1 of the cardboard P1 against the force of the spring 905. A moving amount (hereinafter, "natural moving amount M2") at this time becomes nearly the same value as the thickness t1. Even if the contact unit 902 moves naturally in the above manner, the cardboard P1 held by the transfer nip is pressed against the image carrier 901 with appropriate force by the contact unit 902 biased by the spring 905, and thus an appropriate transfer pressure is ensured. This is a proper transfer pressure to be obtained.

Even if the contact unit 902 is forcibly moved beforehand by pressing the eccentric cam (not shown) against the top surface S of the bearing 908 before causing the cardboard P1 to enter the transfer nip, the proper transfer pressure can be obtained by setting the forcible moving amount M1 to be a value slightly smaller than the thickness t1. This is because the cardboard P1 enters the transfer nip and the contact unit 902 naturally moves downward by a slight difference between the thickness t1 and the forcible moving amount M1, so that the pressure force by the spring 905 is acted on the cardboard P1.

However, if the forcible moving amount M1 is set to a value greater than the thickness t1, the contact unit 902 does not move downward even if the cardboard P1 is caused to enter the transfer nip, and the top surface S of the bearing 908 is kept pressing against the eccentric cam (not shown). Thus, the pressure force by the spring 905 does not act on the cardboard P1. This may cause transfer failure because the proper transfer pressure cannot be obtained. From these results, the present inventors predicted the threshold value would be a value slightly smaller than the thickness t1.

Figure 18:
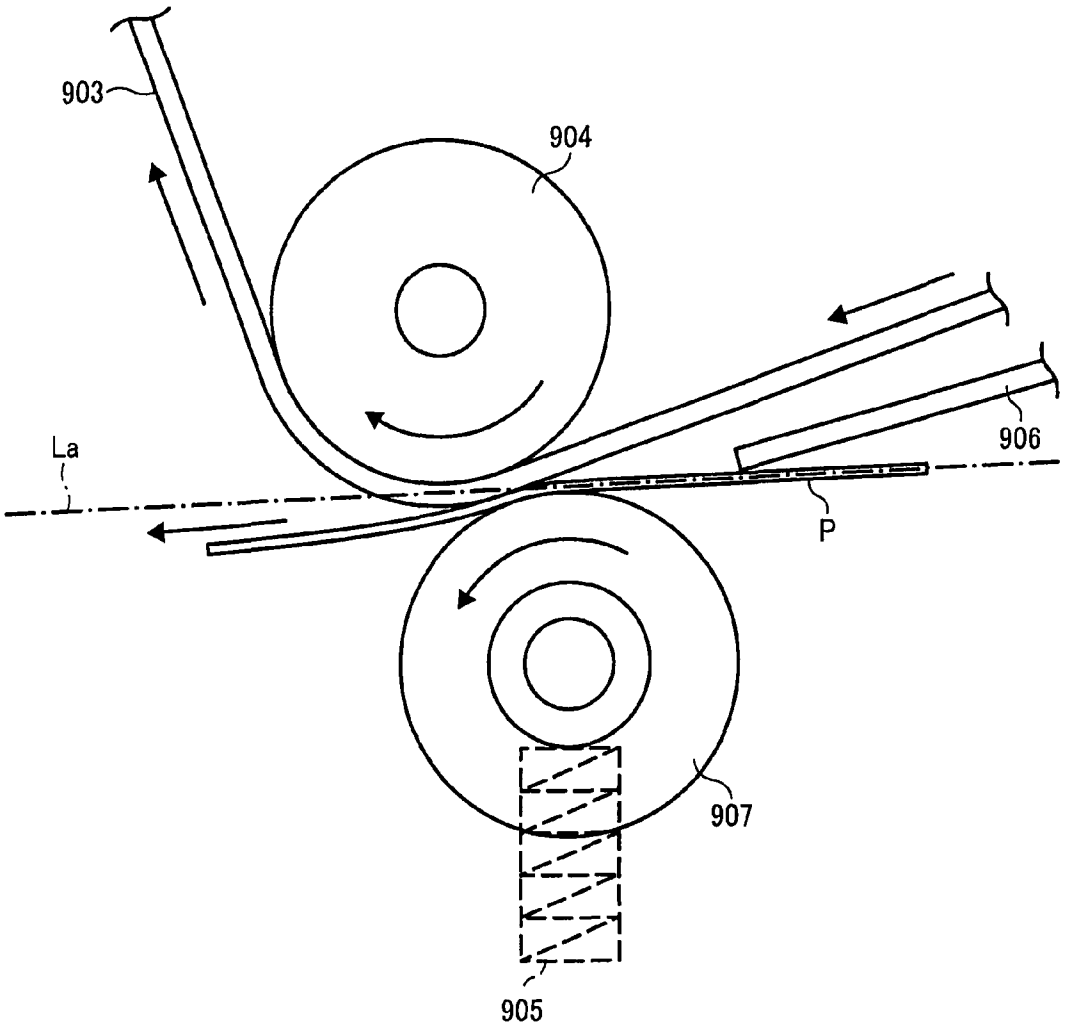
FIG. 18 is a schematic diagram for explaining an example of the secondary transfer nip when a natural moving amount of a secondary transfer roller becomes greater than a thickness of the recording sheet.

Experiments were then performed. As a result, it is found that there is a configuration in which the threshold value becomes greater than the thickness t1, although the threshold value in the configuration shown in FIG. 15 becomes the expected value. For example, the configuration is as shown in FIG. 18. In FIG. 18, an intermediate transfer belt 903 being the image carrier is caused to endlessly move in the clockwise while being wound around the circumferential surface of a transfer opposing roller 904. A secondary transfer roller 907 being the contact unit biased by the spring 905 is in contact with a portion of the intermediate transfer belt 903 that is wound around the transfer opposing roller 904, to form a secondary transfer nip. In the state shown in FIG. 18, the recording sheet P is conveyed toward the secondary transfer nip by the drive of a pair of registration roller (not shown), and enters the secondary transfer nip while the direction of its movement is restricted by a nip-upstream guide plate 906. A portion of the trailing edge side of the recording sheet P, behaving in the above manner, right before entering the secondary transfer nip is in a posture in which the portion is extended along the direction indicated by a dashed one-dotted line La in FIG. 18.

On the other hand, a portion of the leading edge side of the recording sheet P held within the secondary transfer nip is forcibly bent toward the secondary transfer roller 907 than the dashed one-dotted line La. The portion of the leading edge side bending in the above manner has force due to its stiffness so as to be restored to the posture along the dashed one-dotted line La. When the cardboard is used as the recording sheet P, its restoring force is comparatively large, and the secondary transfer roller 907 is thereby depressed downward a little. With this feature, it is found that the natural moving amount M2 of the secondary transfer roller 907 becomes greater than the thickness t1 by the amount of depression due to stiffness of the cardboard. It is also found that even if the natural moving amount M2 becomes greater than the thickness t1, an appropriate transfer pressure is obtained due to the force of the spring 905 and the stiffness of the cardboard. Thus, the threshold value in this case becomes slightly smaller than the natural moving amount M2 and becomes greater than the thickness t1.

The movement of the secondary transfer roller 907 in the configuration in which the guide plate is provided in the upstream of the secondary transfer nip is explained with reference to FIG. 18; however, even if the guide plate is provided in the downstream thereof, the secondary transfer roller 907 may be depressed due to the restoring force caused by the stiffness of the recording sheet in the above manner, depending on the layout of the guide plate.

Furthermore, such a phenomenon that the secondary transfer roller 907 is depressed downward by the restoring force due to the stiffness of the recording sheet may also possibly occur depending on the layout of the registration rollers (not shown). For example, when the registration rollers provided in the upstream of the secondary transfer nip in the sheet conveying direction is placed below the dashed one-dotted line La in FIG. 18, it can be thought that the recording sheet is forcibly bent between a registration nip formed with the registration rollers, and the secondary transfer nip. In this state, if the recording sheet is a stiff sheet such as the cardboard, the restoring force is comparatively large, and thus, the secondary transfer roller is depressed downward a little similarly as explained above due to the restoring force.

As mentioned above, in the configuration in which the stiff recording sheet such as the cardboard is caused to enter the nip in the forcibly bent posture of the recording sheet, the contact unit such as the secondary transfer roller is depressed due to the comparatively large restoring force of the recording sheet. Therefore, the threshold value becomes a value slightly smaller than the natural moving amount M2 and greater than the thickness t1. Thus, it is understood that an appropriate value of the forcible moving amount M1 is not determined by the thickness t1 of the recording sheet but is determined by the natural moving amount M2 upon entering of the recording sheet between the image carrier and the contact unit.

First, the experiments performed by the present inventors related to the second embodiment of the present invention will be explained below.

A printer test machine configured in the above manner as shown in FIG. 18 was prepared. First, the test machine was in such a state that the secondary transfer roller 907 was not forcibly moved by the eccentric cam and the recording sheet P was not fed into the secondary transfer nip (hereinafter, "initial state"). The position of the secondary transfer roller 907 in the initial state is an initial position. The natural moving amount M2 of the secondary transfer roller 907 was measured when the initial state shifted to the state in which the secondary transfer roller 907 was not forcibly moved by the eccentric cam but the recording sheet P was passed through the secondary transfer nip. The natural moving amount M2 was measured in the following manner.

Specifically, a holder (not shown) that movably holds the secondary transfer roller 907 was provided, and a distance sensor capable of measuring a distance between the holder and the sensor was provided above the holder. Then, the natural moving amount M2 was measured based on the result of detection of a distance change by the distance sensor. Two types of sheets were used as the recording sheet P: a 260 $g/m^2$-sheet with a thickness of 240 micrometers and a 350 $g/m^2$-sheet with a thickness of 400 micrometers. It is then found that the natural moving amount M2 upon usage of the 260 $g/m^2$-sheet was about 340 micrometers. It is also found that the natural moving amount M2 upon usage of the 350 $g/m^2$-sheet was about 740 micrometers. In the both cases of using the recording sheets P, the natural moving amount M2 becomes considerably greater than each thickness of the sheets. This is because, as explained above, the leading edge side of the recording sheet P bent in association with entering thereof into the secondary transfer nip was restoring to the original posture, which resulted in depression of the secondary transfer roller 907.

Figure 19:
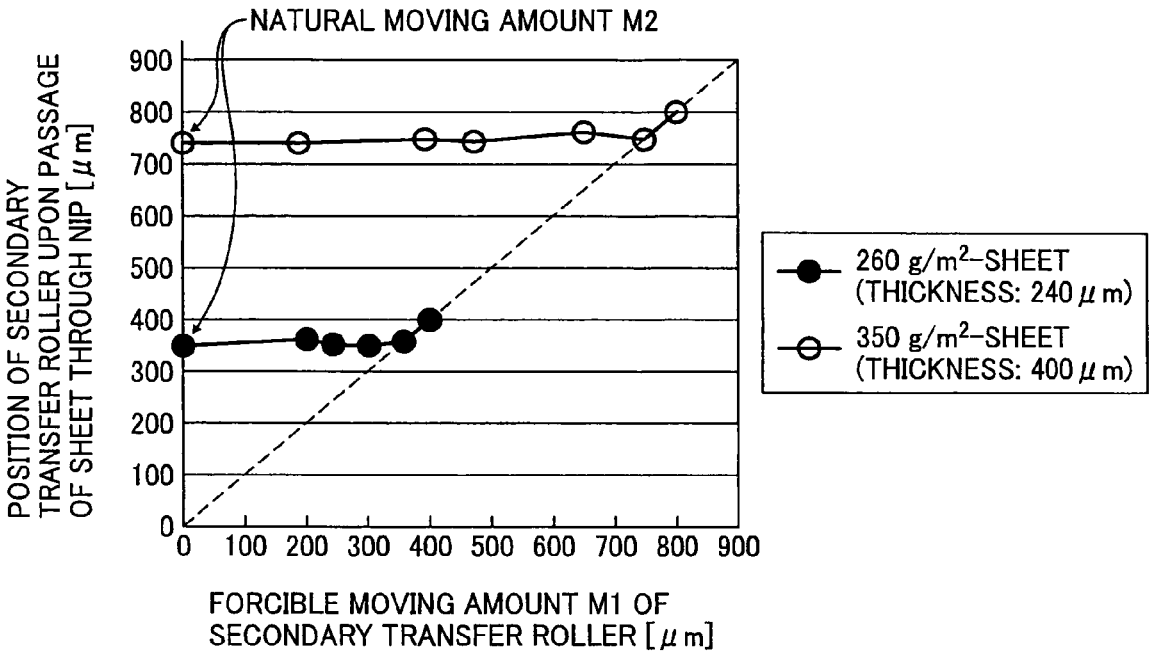
FIG. 19 is a graph representing a relationship between a position and a forcible moving amount of the secondary transfer roller upon passage of a sheet through the nip.

Next, the present inventors performed experiments to measure a position of the secondary transfer roller 907 when each of the two types of recording sheets P was caused to enter the secondary transfer nip after the secondary transfer roller 907 was forcibly moved by the eccentric cam. The position of the secondary transfer roller 907 was represented by a moving amount from the initial position that is set to zero. A forcible moving amount M1 of the secondary transfer roller 907 when it is forcibly moved by the eccentric cam, and a position of the secondary transfer roller 907 when the recording sheet P was caused to enter the secondary transfer nip after the forcible movement were obtained based on the results of detection by the distance sensor. The results are shown in the graph of FIG. 19.

The graph shows that the recording sheet P passes through the secondary transfer nip in a state in which the secondary transfer roller 907 is not forcibly moved by the eccentric cam under the condition that a value of the horizontal axis is zero. In this case, the position of the secondary transfer roller 907 upon passage of the sheet (when the recording sheet P is passed through the secondary transfer nip) becomes naturally the same value as the natural moving amount M2 (260 g/m$^2$-sheet: 340 micrometers, 350 g/m$^2$-sheet: 740 micrometers). It is understood that when the secondary transfer roller 907 is forcibly moved, by setting the forcible moving amount M1 to a value less than the natural moving amount M2, the secondary transfer roller 907 is moved up to the same position as that of the natural moving amount M2 upon passage of any one of the recording sheets P.

Figure 20:
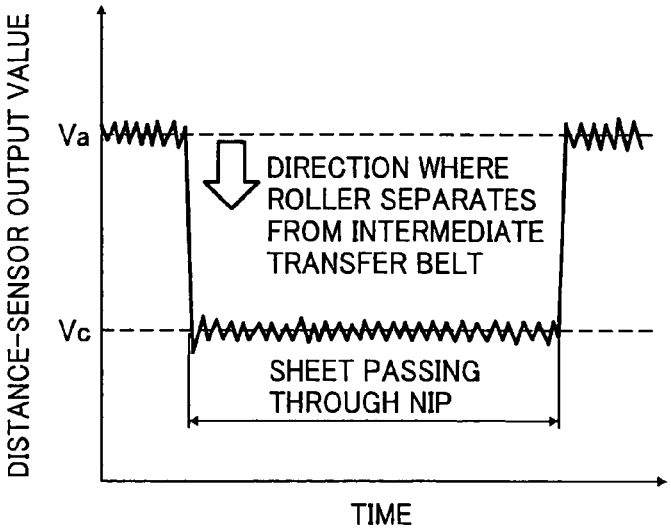
FIG. 20 is a graph representing a change of a distance-sensor output value when the natural moving amount of the secondary transfer roller was measured.

FIG. 20 is a graph representing a change of a distance-sensor output value when the natural moving amount M2 was measured. In the graph, a period in which the distance-sensor output value is nearly a value Va is a period in which the recording sheet P does not enter the secondary transfer nip and the secondary transfer roller 907 is in direct contact with the intermediate transfer belt 903. When the recording sheet P enters the secondary transfer nip, the secondary transfer roller 907 thereby naturally moves downward following the thickness, and then the distance-sensor output value becomes nearly a value Vc. A difference between the value Vc and the value Va represents the natural moving amount M2.

Figure 21:
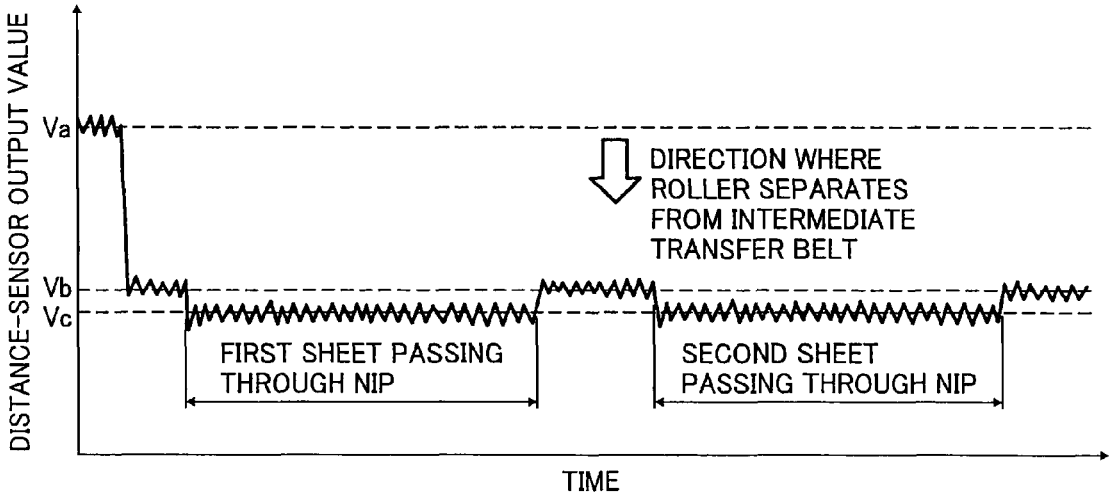
FIG. 21 is a graph representing a change of a distance-sensor output value in an experiment to measure a position of the secondary transfer roller when the recording sheet was caused to enter the secondary transfer nip after the secondary transfer roller was forcibly moved.

FIG. 21 is a graph representing a change of a distance-sensor output value in an experiment to measure a position of the secondary transfer roller 907 when the recording sheet P was caused to enter the secondary transfer nip after the secondary transfer roller 907 was forcibly moved by the eccentric cam. This graph shows a change in the distance-sensor output value when the forcible moving amount M1 of the secondary transfer roller 907 is set to a value smaller than the natural moving amount M2.

In the graph, a period in which the distance-sensor output value is nearly the value Va is a period of the initial state, and in this period, the secondary transfer roller 907 is not forcibly moved by the eccentric cam. Because it is in the initial state, the distance-sensor output value becomes the value Va similarly to the graph as shown in FIG. 6. When the secondary transfer roller 907 is forcibly moved from the initial state by a moving amount smaller than the natural moving amount M2, the distance-sensor output value becomes a value Vb. Thereafter, when the recording sheet P enters the secondary transfer nip, the secondary transfer roller 907 naturally moves downward by a difference between the natural moving amount M2 and forcible moving amount M1, and then the distance-sensor output value becomes the value Vc corresponding to the natural moving amount M2. When the forcible moving amount M1 is set to a value smaller than the natural moving amount M2, the secondary transfer roller 907 upon passage of the sheet through the nip moves to the same position as that of the forcible moving amount M1 in the above manner.

When the forcible moving amount M1 of the secondary transfer roller 907 is set to a value smaller than the natural moving amount M2 (260 g/m$^2$-sheet: exceeding 340 micrometers, 350 g/m$^2$-sheet: exceeding 740 micrometers), the following result is obtained. That is, even if the recording sheet P enters the secondary transfer nip, the position of the secondary transfer roller 907 is the same as that before the entering.

Figure 22:
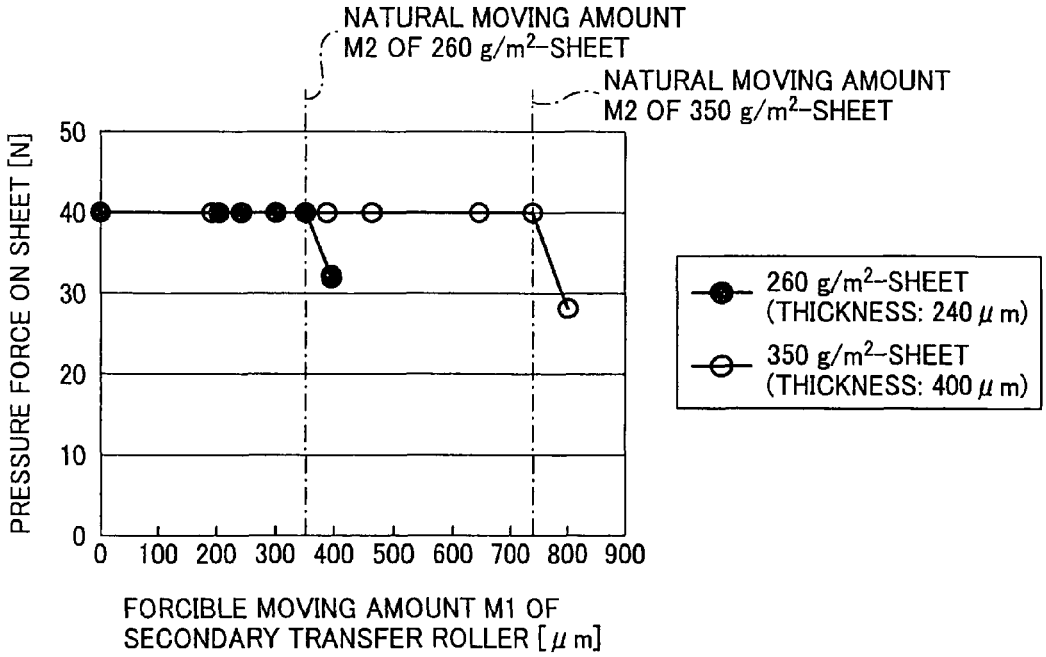
FIG. 22 is a graph representing a relationship between the forcible moving amount of the secondary transfer roller and transfer pressure.

FIG. 22 is a graph representing a relationship between the forcible moving amount M1 of the secondary transfer roller 907 and the pressure force (transfer pressure) applied to the recording sheet P entering the secondary transfer nip after the secondary transfer roller 907 is forcibly moved. It is understood from the graph that if the forcible moving amount M1 is set to a value equal to or less than the natural moving amount M2, the transfer pressure of 40 Newtons that is exerted when the secondary transfer roller 907 is not forcibly moved by the eccentric cam is obtained. This indicates that occurrence of transfer failure due to low transfer pressure can be prevented by setting the forcible moving amount M1 to a value equal to or less than the natural moving amount M2.

The present inventors performed experiments to examine a relationship between the forcible moving amount M1 and linear uneven density due to sharp load fluctuation, upon entering or discharging of the sheet into or from the secondary transfer nip. Specifically, after the secondary transfer roller 907 was forcibly moved from the initial position by the eccentric cam, a predetermined test image was formed on the intermediate transfer belt 903, and the formed image was secondarily transferred to the recording sheet P that was caused to enter the secondary transfer nip. It is then observed whether there was linear uneven density in the test image having been transferred to the recording sheet P. As a result, it is found that although within an allowable range, slight linear uneven density is caused by setting the forcible moving amount M1 to the same value as the sheet thickness in the printer test machine in which the natural moving amount M2 becomes a value greater than the thickness of the recording sheet P. It is also found that by gradually increasing the forcible moving amount M1 more than the sheet thickness, the linear uneven density is gradually reduced and is completely eliminated at the end.

A basic configuration of a printer according to a first example of the second embodiment of the present invention is the same as that of FIG. 4; however, only the thickness sensor 38 is used therein. Therefore, explanation of the basic configuration is omitted.

In FIG. 4, the rotating shaft of the secondary transfer roller 72 is rotatably borne by the bearing fixed to the swing arm 76 being the holder. The swing arm 76 is swingably supported around the swing shaft 76*a*, and its own swinging is caused to change a distance (hereinafter, "inter-shaft distance") between the rotating shaft of the secondary transfer roller 72 and the rotating shaft of the transfer opposing roller 68.

Fixed to each lower edge of the swing arm 76 is the biasing coil spring 78 being the biasing unit. The biasing coil spring 78 applies biasing force to the swing arm 76 so as to bias it around the swing shaft 76*a* in the counterclockwise in FIG. 4, and the secondary transfer roller 72 is pressed against the intermediate transfer belt 61.

The cam face of the eccentric cam 80 is in contact with the upper surface of the end of the swing arm 76 on the opposite side to the swing shaft 76*a*. When the eccentric cam 80 is driven to rotate by the cam motor (not shown), the swing arm 76 is caused to gradually rotate clockwise in FIG. 4 so as to depress the swing arm 76 against the biasing force of the biasing coil spring 78. The inter-shaft distance between the secondary transfer roller 72 and the transfer opposing roller 68 is thereby gradually widened. The size of the secondary transfer nip is getting smaller in association with the widening, and the secondary transfer roller 72 eventually separates from the intermediate transfer belt 61.

As explained above, in the printer, by moving the secondary transfer roller 72 against the biasing force due to the biasing coil spring 78, the distance or the inter-shaft distance between the rotating shaft of the transfer opposing roller 68 being a belt support and the secondary transfer roller 72 is adjusted. In this configuration, the eccentric cam 80, the cam motor 79, and the controller that drives the motor function as a distance adjusting unit. It is noted that widening of the inter-shaft distance by the rotation of the eccentric cam 80 indicates an increase in the forcible moving amount M1.

The thickness sensor 38 being a thickness-information acquiring unit is arranged in the right side of the registration rollers 37 in FIG. 4. The thickness sensor 38 detects the thickness of the recording sheet P before being fed into the registration rollers 37, and outputs the result of detection to the controller 82. The printer uses, as the thickness sensor 38, a sensor for detecting the thickness based on a transmitted light amount of the recording sheet P. Any other sensor can also be used if it detects the thickness of the recording sheet P based on a displacement of rollers when the recording sheet P is held between the registration rollers 37 or if it detects the thickness of the recording sheet P based on a distance between the sensor and the surface of the recording sheet P.

Figure 14:
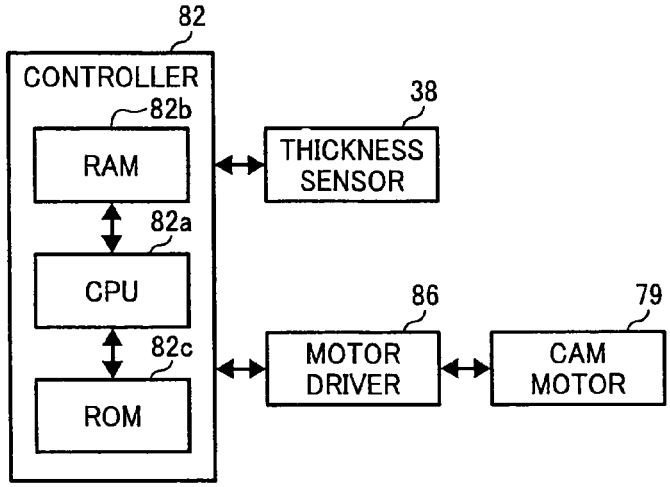
FIG. 14 is a block diagram of a part of an electric circuit of a copy machine according to a first example of a second embodiment of the present invention.

FIG. 14 is a block diagram of a part of an electric circuit of the copy machine according to the first example of the second embodiment. The controller 82 includes a central processing unit (CPU) 82*a* being a calculating unit, a random access memory (RAM) 82*b* being a data storage unit, and a read only memory (ROM) 82*c* being a data storage unit. The controller 82 controls the drive of various devices provided inside the printer and sets operating conditions. The thickness sensor 38 is connected to the controller 82 as explained above. The cam motor 79 is connected to the controller 82 through a motor driver 86. The cam motor 79 rotates the eccentric cam 80.

The ROM 82*c* stores therein a data table of natural moving amounts constructed based on the experiments performed in advance or the like. In the data table of natural moving amounts, the thicknesses of recording sheets obtained by the experiments performed in advance are associated with the natural moving amounts M2 each being an amount of change in the inter-shaft distance of the secondary transfer roller 72 due to natural movement. Here, the natural movement of the secondary transfer roller 72 indicates natural downward movement of the secondary transfer roller 72 following the thickness of the sheet when the initial state in which the secondary transfer roller is located in the initial position is shifted to the state in which the recording sheet is passed through the secondary transfer nip.

A specific example of the data table of the natural moving amounts is shown in Table 1. In Table 1, the left column represents a thickness t of the recording sheet. The right column represents the natural moving amount M2. In Table 1, the thickness t of the recording sheet is set to ranges divided by 0.02 millimeters, and a natural moving amount M2 of the secondary transfer roller corresponding to the thickness t is set therein. In the specific example, a table in which the natural moving amount M2 is set to the thickness t or more of the recording sheet is used as a peripheral configuration of the secondary transfer roller.

TABLE 1

| Range of detected thickness t of sheet [mm] | Natural moving amount M2 [mm] |
|---|---|
| $t < 0.18$ | Not depressed |
| $0.18 \leqq t < 0.20$ | 0.21 |
| $0.20 \leqq t < 0.22$ | 0.25 |
| $0.22 \leqq t < 0.24$ | 0.29 |
| $0.24 \leqq t < 0.26$ | 0.33 |
| $0.26 \leqq t < 0.28$ | 0.37 |
| $0.28 \leqq t < 0.30$ | 0.41 |
| $0.30 \leqq t < 0.32$ | 0.45 |
| $0.32 \leqq t < 0.34$ | 0.49 |
| $0.34 \leqq t < 0.36$ | 0.53 |
| $0.36 \leqq t < 0.38$ | 0.57 |
| $0.38 \leqq t < 0.40$ | 0.61 |
| $0.40 \leqq t$ | 0.65 |

The ROM 82*c* also stores therein a data table of forcible moving/driving amounts. The data table of forcible moving/driving amounts is a data table indicating a relationship between a driving amount of the cam motor 79 and a forcible moving amount M1 of the secondary transfer roller 72 driven by the cam motor 79.

Referring back to FIG. 4, the thickness sensor 38 being the thickness-information acquiring unit detects the thickness of the recording sheet held by the registration rollers 37. The result of detection is sent to the controller 82. The controller 82 causes the cam motor 79 to rotate the eccentric cam 80 before the recording sheet is fed into the secondary transfer nip through rotation of the registration rollers 37, to forcibly move the secondary transfer roller 72 and adjust the inter-shaft distance. At this time, the forcible moving amount M1 of the secondary transfer roller 72 is set as follows.

Specifically, the controller 82 specifies the natural moving amount M2 of the secondary transfer roller 72 corresponding to the result of detection of the thickness by the thickness sensor 38 from the data table of natural moving amounts as shown in Table 1. The controller 82 determines a value equal to or less than the natural moving amount M2 as the forcible moving amount M1 of the secondary transfer roller 72, and specifies the driving amount of the cam motor 79 corresponding to the determined value from the data table of forcible moving/driving amounts. By driving the cam motor 79 with the driving amount the same as the specified result, the secondary transfer roller 72 is forcibly moved by the amount equal to or less than the natural moving amount M2. Thereafter, the registration rollers 37 are driven to rotate and send the recording sheet toward the secondary transfer nip.

In the printer according to the first example, a sheet conveying path employed herein has a following structure. Specifically, similarly to the configuration as shown in FIG. 4, the structure is such that the force in a direction of widening the inter-shaft distance is applied to the secondary transfer roller 72 being the contact unit by the stiffness of the recording sheet held by the secondary transfer nip. Therefore, the natural moving amount M2 of the secondary transfer roller 72 as shown in FIG. 4 becomes wider than the thickness of the recording sheet. In the configuration, as explained above, by setting a value equal to or more than the thickness of the recording sheet as the forcible moving amount M1, linear uneven density occurring due to the sharp load fluctuation can be kept within an allowable range even upon entering or discharging of the sheet into or from the nip. Thus, in the printer, the controller 82 being a part of the distance adjusting unit is configured so as to determine a value equal to or less than the natural moving amount M2, as the forcible moving amount M1 of the secondary transfer roller 72.

In the data table of natural moving amounts in Table 1, the thickness t of the recording sheet is divided into ranges by 20 micrometers, and the natural moving amount M2 is set corresponding to each range. However, if a memory capacity of the ROM 82*c* is allowed, the thickness t of the recording sheet can be divided into smaller ranges, so that the natural moving amount can also be set accordingly. Furthermore, if the memory capacity of the ROM 82*c* is limited, the thickness t thereof can also be divided into larger ranges. Moreover, if the memory capacity of the ROM 82*c* is desired to be reduced, it is also possible to derive a predetermined relational expression from the correlation between the thickness t of the recording sheet and the natural moving amount M2 shown in Table 1, and to obtain the natural moving amount M2 by substituting the thickness information of the recording sheet acquired from the thickness-information acquiring unit into the relational expression.

As the thickness-information acquiring unit, a thickness entry key used to perform a thickness entry operation by a user can be employed instead of the thickness sensor 38. In this case, a message prompting the user to enter the thickness is informed to the user each time a feeding operation or a replacing operation of the recording sheet in a sheet feeding cassette (not shown) is detected. A plurality of sheet-type buttons such as a sheet-type A button and a sheet-type B button is prepared, and a sheet-type button corresponding to the recording sheet in the sheet feeding cassette can be depressed by the user, to acquire thickness information. In this case, an item number list for sheet with thicknesses corresponding to the sheet-type buttons is described in manuals or the like, and the sheet-type button corresponding to the set sheet in the sheet feeding cassette is simply specified by the user based on the item number list.

In a case of a comparatively thin recording sheet, the linear uneven density does not occur caused by the sharp load fluctuation, upon entering or discharging of the sheet into or from the secondary transfer nip. When a ream weight of recording sheets exceeds nearly 100 kilograms, the linear uneven density occurs depending on the structure of the secondary transfer nip and its peripheral. This means that when the thickness of the recording sheet is below a predetermined value, adjustment of the inter-shaft distance by the forcible movement of the secondary transfer roller 72 is wasteful. In the printer according to the first example, therefore, the controller 82 is configured so as to adjust the inter-shaft distance by the forcible movement of the secondary transfer roller 72 only when the result of detection of the thickness by the thickness sensor 38 becomes the predetermined value or more.

When the print job is finished, the controller 82 reversely rotates the cam motor 79 to return the position of the secondary transfer roller 72 to the initial state. In a continuous printing operation for continuously printing an image on a plurality of recording sheets, an inter-shaft distance is adjusted before a first sheet is passed through the secondary transfer nip, and then the adjusted inter-shaft distance is kept during the continuous printing operation. After the continuous print job is finished, the position of the secondary transfer roller 72 is returned to the initial state.

Therefore, in the printer according to the first example, the controller 82 being a part of the distance adjusting unit is configured so as to adjust the distance in such a manner that a difference between the inter-shaft distance being a first inter-shaft distance and the inter-shaft distance being a second inter-shaft distance, which are explained below, is set to a value equal to or less than a natural moving amount M2 specified based on the data table of natural moving amounts stored in the ROM 82*c*. The first inter-shaft distance is in the state where the distance is not adjusted by the distance adjusting unit including the eccentric cam 80 and the controller 82 and the recording sheet is not fed into the secondary transfer nip between the intermediate transfer belt 61 and the secondary transfer roller 72. The second inter-shaft distance is in the state where the distance is adjusted but the recording sheet is not fed into the secondary transfer nip. In the configuration, as explained above, even if the inter-shaft distance is widened by forcibly moving the secondary transfer roller 72, it is possible to reliably ensure desired transfer pressure and prevent occurrence of transfer failure due to low transfer pressure.

The thickness sensor 38 that detects the thickness of the recording sheet is shown in FIG. 4 as a configuration of a printer according to a second example of the second embodiment of the present invention. However, a case where the thickness sensor 38 is not used but the distance sensor 81 is used will be explained below. The distance sensor 81 outputs a voltage according to a distance between the sensor and the swing shaft 76*a* to be detected (swing shaft) of the swing arm 76.

As explained above, when the recording sheet is passed through the secondary transfer nip, the swing arm 76 follows the thickness of the recording sheet and naturally moves downward from the initial state in which the secondary transfer nip is formed at the initial position. At this time, the inter-shaft distance is widened, and a sensor-arm distance that is a distance between the distance sensor 81 and the swing shaft 76*a* is also widened, and an output value of the distance sensor 81 thereby changes. Although the amount of change in the inter-shaft distance is not the same as the amount of change in the sensor-arm distance, an excellent correlation is established between the two. The controller 82 stores algorithm indicating a relationship between the two in the ROM 82*c*, and can obtain the natural moving amount M2 of the secondary transfer roller 72 when the initial state is shifted to the state where the recording sheet is passed through the secondary transfer nip, based on the amount of change in the output voltage of the distance sensor 81 and the algorithm. In other words, the printer according to the second example includes a distance-change detector that is formed with the distance sensor 81 and the controller 82 and detects a change in the inter-shaft distance.

When receiving an instruction for a one-sheet printing operation to form an image only on one recording sheet, first, the controller 82 feeds a recording sheet within a sheet feeding cassette (not shown) into the secondary transfer nip in a state where a toner image is not formed on each of the photosensitive elements or the intermediate transfer belt 61. At this time, the controller 82 obtains a natural moving amount M2 of the secondary transfer roller 72 corresponding to the recording sheet based on the amount of change in an output voltage of the distance sensor 81. Then, similarly to the first example, the controller 82 determines a forcible moving amount M1 based on the natural moving amount M2 and, thereafter, forcibly moves the secondary transfer roller 72 through the rotation of the eccentric cam 80 by the forcible moving amount M1, to widen the inter-shaft distance. Thereafter, a next recording sheet is passed through the secondary transfer nip while a toner image is formed on the intermediate transfer belt 61 through an image forming process, and the toner image on the belt is secondarily transferred to the recording sheet.

The hardness of the elastic element of the secondary transfer roller 72 changes due to alteration in the environment and degradation over time, which may cause change in the relationship between the thickness of the recording sheet and the natural moving amount M2. Even in this case also, by determining a forcible moving amount M1 based on an actually measured natural moving amount M2, the printer can prevent low transfer pressure and linear uneven density caused by the change in the relationship between the thickness of the recording sheet and the natural moving amount M2.

When receiving an instruction for the continuous printing operation to continuously form an image on a plurality of recording sheets, at first, the controller 82 performs printing operation on a first recording sheet in a state in which the inter-shaft distance is not adjusted by forcibly moving the secondary transfer roller 72. At this time, the controller 82 obtains a natural moving amount M2 of the secondary transfer roller 72 based on the amount of change in an output voltage of the distance sensor 81. Next, before a second recording sheet is caused to enter the secondary transfer nip, the controller 82 determines a forcible moving amount M1 based on the natural moving amount M2 similarly to the first example, and adjusts the inter-shaft distance by forcibly moving the secondary transfer roller 72 through rotation of the eccentric cam 80 by the forcible moving amount M1. Then, the second and subsequent recording sheets are sequentially passed through the secondary transfer nip while the inter-shaft distance is kept as it is. In the configuration, it is possible to prevent a printing time from increasing caused by such a process sequence that the natural moving amount M2 is measured while the recording sheet with no toner image thereon is passed through the secondary transfer nip and then the image forming operation is started.

When the natural moving amount M2 is comparatively small because of a comparatively small thickness of the recording sheet, there are some cases where linear uneven density does not occur even if the secondary transfer roller 72 is not forcibly moved by the eccentric cam 80. Thus, the inter-shaft distance can be adjusted by forcibly moving the secondary transfer roller 72 only when the result of measurement of the natural moving amount M2 becomes the predetermined value or more.

Furthermore, setting of the plain sheet mode and setting of the cardboard mode can be switched through user's operation, and only when the cardboard mode is set, the inter-shaft distance can be adjusted based on a measured value of the natural moving amount M2.

Moreover, because only one type of recording sheets is generally stored in the sheet feeding cassette, only when the recording sheets are supplied in the sheet feeding cassette or only when they are replaced with any other type, the secondary transfer roller 72 can be forcibly moved based on a measured value of the natural moving amount M2.

Therefore, in the printer according to the second example, the controller 82 being a part of the distance adjusting unit is configured so as to adjust the distance in such a manner that a difference between the inter-shaft distance being a first inter-shaft distance and the inter-shaft distance being a second inter-shaft distance explained below is set to a value equal to or less than the result of measurement of the natural moving amount M2 of the secondary transfer roller 72 by the distance sensor 81. Specifically, the first inter-shaft distance is in the initial state where the distance is not adjusted by the distance adjusting unit including the eccentric cam 80 and the recording sheet is not fed into the secondary transfer nip. The second inter-shaft distance is in the state where the distance is adjusted but the recording sheet is not fed into the secondary transfer nip. This configuration also enables desired transfer pressure to be reliably ensured and transfer failure due to low transfer pressure to be prevented even if the inter-shaft distance is widened by forcibly moving the secondary transfer roller 72.

As a basic configuration of a printer according to a third example of the second embodiment of the present invention, a case in which both the thickness sensor 38 and the distance sensor 81 are provided in FIG. 4 will be explained below. The RAM 82*b* of the controller 82 stores a measured-value data table that stores therein the results of detection of a thickness by the thickness sensor 38 associated with the results of measurement of natural moving amounts M2 of the secondary transfer roller 72 by the distance sensor 81 when a recording sheet with the thickness is used. Detection of a thickness by the thickness sensor 38 and measurement of a natural moving amount M2 of the secondary transfer roller 72 by the distance sensor 81 are executed each time printing is performed, and obtained each thickness of the recording sheets and obtained each natural moving amount M2 of the secondary transfer roller 72 are sequentially input into the data table, to create a data table close to Table 1.

When the natural moving amount M2 equivalent to the thickness the same as the result of detection by the thickness sensor 38 is stored in the measured-value data table, a forcible moving amount M1 is determined based on the natural moving amount M2 before the recording sheet is fed into the secondary transfer nip, and the secondary transfer roller 72 is forcibly moved by the eccentric cam. Next, the toner image on the intermediate transfer belt 61 is secondarily transferred to the recording sheet while causing the recording sheet to pass through the secondary transfer nip. In the configuration, it is possible to eliminate the need for such a time-consuming process that the natural moving amount M2 is measured while the recording sheet with no toner image thereon is passed through the secondary transfer nip, as explained in the second example. Moreover, the thickness of the recording sheet is detected by the thickness sensor 38, and the natural moving amount M2 of the secondary transfer roller 72 is measured by the distance sensor 81 when the recording sheet is fed into the secondary transfer nip without forcible movement of the secondary transfer roller 72.

There may be a case where there occurs a difference between the result of measurement of the natural moving amount M2 of the secondary transfer roller 72 and the value of the natural moving amount M2, stored in the measured-value data table, corresponding to the thickness of the recording sheet detected by the thickness sensor 38. Alternatively, there may be a case where the difference becomes a predetermined value or more. If either one of the cases, the value of the natural moving amount M2 stored in the measured-value data table is updated to the measured natural moving amount M2. As explained above, by enabling to update the value of the natural moving amount M2 stored in the data table if needed, a displacement can be appropriately resolved even if there occurs the displacement between the natural moving amount M2 of the secondary transfer roller 72 stored in the data table and the actually measured natural moving amount M2, the displacement being caused by change over time of the drive portion of the eccentric cam 80, the secondary transfer roller 72, and of the biasing coil spring 78 being the biasing unit. The resolution of the displacement enables uneven density due to sharp load fluctuation on the image carrier to be minimized with higher precision.

The explanation is made on the case in which the thickness is detected by the thickness sensor 38 and the natural moving amount M2 of the secondary transfer roller 72 is measured by the distance sensor 81 each time printing is performed, and in which a natural moving amount is updated to an actually measured value of the natural moving amount M2 by the distance sensor 81, the natural moving amount being created by sequentially inputting each obtained thickness of the recording sheets and each obtained natural moving amount M2 of the secondary transfer roller 72 into the data table. However, it is also possible to update the natural moving amount M2 of the secondary transfer roller 72, having been set based on the results obtained by the experiments performed in advance as shown in Table 1 explained in the second example, to a measured value of the natural moving amount M2 of the secondary transfer roller 72 by the distance sensor 81. With the update in the above manner, similarly to the explanation made so far, it is possible to more precisely minimize uneven density due to sharp load fluctuation on the image carrier.

The explanation is made so far on the example of adjusting the inter-shaft distance by moving the secondary transfer roller 72, of the intermediate transfer belt 61 being the image carrier and the secondary transfer roller 72 being the contact unit. However, the inter-shaft distance can be adjusted by moving the image carrier.

The explanation is further made on the printer configured to transfer the toner image on the belt to the recording sheet P held between the intermediate transfer belt 61 and the secondary transfer roller 72. However, the present invention is also applicable to a configuration in which a visible image on the image carrier is transferred to the recording sheet P held between the secondary transfer roller and the drum-shaped image carrier. Furthermore, the present invention is applicable to a configuration in which a visible image on the image carrier is transferred to the recording sheet held between the image carrier and the portion of the belt element that is wound around a roller element while the belt element is stretched and supported by the roller element.

Therefore, in the printer according to the third example, the controller 82 being a part of the distance adjusting unit is configured so as to adjust the inter-shaft distance based on data when the controller 82 includes the CPU 82*a* being a storage control unit that stores the measured-value data table in the RAM 82*b*, the data table storing therein the results of detection by the thickness sensor 38 associated with the results of measurement of the natural moving amount M2 by the distance-change detector, and when the data for the natural moving amounts M2 corresponding to the results of detection by the thickness sensor 38 is stored in the measured-value data table. As explained above, in the configuration, it is possible to eliminate the need for such a time-consuming process that the natural moving amount M2 is measured while the recording sheet with no toner image thereon is passed through the secondary transfer nip.

The printer according to the third example is provided with the distance sensor 81 being the distance-change detector that detects a change in the inter-shaft distance, and with the controller 82 being the changing unit that changes the amount of change in the inter-shaft distance stored in the RAM 82*b* based on the result of detection by the distance sensor 81 when there occurs a difference between the amount of change in the inter-shaft distance stored in the RAM 82*b* and the amount of change in the inter-shaft distance detected by the distance sensor 81 in the state where the distance is not adjusted by the distance adjusting unit but the recording sheet is passed through the secondary transfer nip.

In the configuration, as explained above, a displacement can be appropriately resolved even if there occurs the displacement between the natural moving amount M2 of the secondary transfer roller 72 stored in the data table and the actually measured natural moving amount M2, the displacement being caused by change over time of the drive portion of the eccentric cam 80, the secondary transfer roller 72, and of the biasing coil spring 78 being the biasing unit. The resolution of the displacement enables uneven density due to sharp load fluctuation on the image carrier to be minimized with higher precision.

In the printer according to the second embodiment, the sheet conveying path is provided in the upstream side or the downstream side of the secondary transfer nip that is the contact portion between the intermediate transfer belt 61 and the secondary transfer roller 72 in the sheet conveying direction. The sheet conveying path is structured so that the force in a direction of widening the inter-shaft distance is applied to the intermediate transfer belt 61 and the secondary transfer roller 72 by the stiffness of the recording sheet held by the secondary transfer nip. In addition, the controller 82 being the part of the distance adjusting unit is configured so as to adjust the distance in such a manner that the difference between the first inter-shaft distance and the second inter-shaft distance is set to a value equal to or more of the result of detection of the thickness by the thickness sensor 38. Specifically, the first inter-shaft distance is in the initial state in which the distance is not adjusted by the distance adjusting unit and the recording sheet is not fed into the secondary transfer nip. The second inter-shaft distance is in the state in which the distance is adjusted but the recording sheet is not fed into the secondary transfer nip. As explained above, in the configuration, linear uneven density due to the sharp load fluctuation can be kept within the allowable range even upon entering or discharging of the sheet into or from the secondary transfer nip.

In the printer according to the second embodiment, the controller 82 being the part of the distance adjusting unit is configured so as to adjust the inter-shaft distance only when the result of detection by the thickness sensor 38 becomes the predetermined value or more. This configuration enables to prevent an increase in the printing time due to unnecessary adjustment of the inter-shaft distance by forcibly moving the secondary transfer roller 72.

The image forming apparatus according to the present invention includes the transfer unit that transfers a visible image carried on the surface of the image carrier to the recording sheet held between the rotator and the image carrier. The image forming apparatus configured in the above manner is applicable to a copy machine, a facsimile machine, a printer, or the like, and is particularly suitable for an image forming apparatus that includes the transfer unit that transfers a visible image formed on the image carrier to the recording sheet passing through between the image carrier and the contact unit that can come in contact with the image carrier, and also includes the distance adjusting unit that adjusts a distance between the image carrier and the contact unit.

According to an aspect of the present invention, it is possible to prevent occurrence of linear uneven density due to sharp load fluctuation on the image carrier upon entering or discharging of the sheet into or from the transfer nip while avoiding occurrence of transfer failure due to low transfer pressure.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a transfer unit configured to transfer a visible image onto a recording sheet and a fixing unit configured to fix the visible image on the recording sheet by heating the recording sheet the transfer unit including, an image carrier that includes a first rotating shaft and is rotatable around the first rotating shaft, or that has a belt-shape and is wound around a belt support unit that includes a second rotating shaft and is rotatable around the second rotating shaft;

a contact unit configured to come in contact with a surface of the image carrier, a biasing unit to apply a biasing force to either one of the image carrier and the contact unit to be brought into contact with another one of the image carrier and the contact unit, a thickness-information acquiring unit to acquire thickness information of the recording sheet, and a distance adjusting unit to adjust an inter-unit distance between the contact unit and either one of the first rotating shaft and the second rotating shaft by moving the either one of the image carrier and the contact unit by applying an opposing force to the either one of the image carrier and the contact unit against the biasing force based on the thickness information; and a data storage unit to store data indicating a relationship between the thickness information and an inter-unit distance change amount, the inter-unit distance change amount being a change in the inter-unit distance when a state where the distance adjusting unit does not apply the opposing force against the biasing force and the recording sheet is not fed into a nip between the image carrier and the contact unit is shifted to a state where the recording sheet is passed through the nip without the distance adjusting unit applying the opposing force against the biasing force, wherein the distance adjusting unit adjusts the inter-unit distance based on the thickness information and the data stored in the data storage unit to transfer the visible image formed on the surface of the image carrier onto the recording sheet passed through the nip.

2. The image forming apparatus according to claim 1, wherein the distance adjusting unit adjusts the inter-unit distance so that an inter-unit distance difference between a state where the distance adjusting unit does not apply the opposing force against the biasing force and the recording sheet is not fed into the nip and a state where the distance adjusting unit adjusts the inter-unit distance by applying the opposing force against the biasing force but the recording sheet is not fed into the nip is equal to or less than the inter-unit distance change amount.

3. The image forming apparatus according to claim 1, wherein the distance adjusting unit includes a sheet conveying path provided in either one of an upstream side and a downstream side of a contact portion between the image carrier and the contact unit in a sheet conveying direction, the sheet conveying path being structured so that a force is applied to the either one of the image carrier and the contact unit to widen the inter-unit distance by stiffness of the recording sheet, and the distance adjusting unit adjusts the inter-unit distance so that an inter-unit distance difference between a state where the distance adjusting unit does not apply the opposing force against the biasing force and the recording sheet is not fed into the nip and a state where the distance adjusting unit adjusts the inter-unit distance by applying the opposing force against the biasing force but the recording sheet not fed into the nip is equal to or more than a value indicated by the thickness information.

4. The image forming apparatus according to claim 1, further comprising:

a distance-change detector that detects a change in the inter-unit distance; and a changing unit that, when there occurs a difference between the inter-unit distance change amount stored in the data storage unit and the inter-unit distance change amount detected by the distance-change detector in the state where the recording sheet is passed through the nip without the distance adjusting unit applying the opposing force against the biasing force, changes the inter-unit distance change amount stored in the data storage unit based on the inter-unit distance change amount detected by the distance-change detector.

5. The image forming apparatus according to claim 1, wherein the distance adjusting unit is configured so that the inter-unit distance is adjusted only when the thickness information indicates a predetermined value or more.

6. The image forming apparatus according to claim 1, wherein the distance adjusting unit adjusts the inter-unit distance by moving the contact unit.

7. An image forming apparatus comprising:

a transfer unit configured to transfer a visible image onto a recording sheet and a fixing unit configured to fix the visible image on the recording sheet by heating the recording sheet, the transfer unit including:

an image carrier that includes a first rotating shaft and is rotatable around the first rotating shaft, or that has a belt-shape and is wound around a belt support unit that includes a second rotating shaft and is rotatable around the second rotating shaft;

a contact unit configured to come in contact with a surface of the image carrier;

a biasing unit to apply a biasing force to either one of the image carrier and the contact unit to be brought into contact with another one of the image carrier and the contact unit;

a distance adjusting unit to adjust an inter-unit distance between the contact unit and either one of the first rotating shaft and the second rotating shaft by moving the either one of the image carrier and the contact unit by applying an opposing force to the either one of the image carrier and the contact unit against the biasing force; and a distance-change detector to detect an inter-unit distance change amount that is a change in the inter-unit distance when a state where the distance adjusting unit does not apply the opposing force against the biasing force and the recording sheet is not fed into a nip between the image carrier and the contact unit is shifted to a state where the recording sheet is passed through the nip without the distance adjusting unit applying the opposing force against the biasing force, wherein the distance adjusting unit adjusts the inter-unit distance based on the inter-unit distance change amount detected by the distance-change detector to transfer the visible image formed on the surface of the image carrier onto the recording sheet passed through the nip.

8. The image forming apparatus according to claim 7, wherein the distance adjusting unit adjusts the inter-unit distance so that an inter-unit distance difference between a state where the distance adjusting unit does not apply the opposing force against the biasing force and the recording sheet is not fed into the nip and a state where the distance adjusting unit adjusts the inter-unit distance by applying the opposing force against the biasing force but the recording sheet is not fed into the nip is equal to or less than the inter-unit distance change amount.

9. The image forming apparatus according to claim 7, further comprising a thickness-information acquiring unit that acquires thickness information of the recording sheet, wherein the distance adjusting unit includes a sheet conveying path provided in either one of an upstream side and a downstream side of a contact portion between the image carrier and the contact unit in a sheet conveying direction, the sheet conveying path being structured so that a force is applied to the either one of the image carrier and the contact unit to widen the inter-unit distance by stiffness of the recording sheet, and the distance adjusting unit adjusts the inter-unit distance so that an inter-unit distance difference between a state where the distance adjusting unit does not apply the opposing force against the biasing force and the recording sheet is not fed into the nip and a state where the distance adjusting unit adjusts the inter-unit distance by applying the opposing force against the biasing force but the recording sheet not fed into the nip is equal to or more than a value indicated by the thickness information.

10. The image forming apparatus according to claim 9, further comprising:

a data storage unit; and a storage control unit that stores the thickness information and the inter-unit distance change amount detected by the distance-change detector in the data storage unit in association with each other, wherein the distance adjusting unit adjusts the inter-unit distance based on the thickness information and the inter-unit distance change amount stored in the data storage unit.

11. The image forming apparatus according to claim 10, wherein the storage control unit, when there occurs a difference between the inter-unit distance change amount stored in the data storage unit and the inter-unit distance change amount detected by the distance-change detector in the state where the recording sheet is passed through the nip without the distance adjusting unit applying the opposing force against the biasing force, changes the inter-unit distance change amount stored in the data storage unit based on the inter-unit distance change amount detected by the distance-change detector.

12. The image forming apparatus according to claim 7, wherein the distance-change detector detects the inter-unit distance change amount while the recording sheet is passed through the nip without the distance adjusting unit applying the opposing force against the biasing force in a state where a visible image is not formed on the surface of the image carrier, the distance adjusting unit adjusts the inter-unit distance based on the inter-unit distance change amount detected by the distance-change detector, and the visible image formed on the image carrier is transferred onto another recording sheet by passing the another recording sheet through the nip formed after the distance adjusting unit adjusts the inter-unit distance.

13. The image forming apparatus according to claim 7, wherein when an image is continuously formed on a plurality of recording sheets having same thickness by passing the recording sheets through the nip, the distance-change detector detects the inter-unit distance change amount while the visible image is transferred onto a first recording sheet from the image carrier without the distance adjusting unit applying the opposing force against the biasing force, and the distance adjusting unit adjusts the inter-unit distance based on the inter-unit distance change amount detected by the distance-change detector before second and subsequent recording sheets are fed into the nip.

14. The image forming apparatus according to claim 7, wherein the distance adjusting unit is configured so that the inter-unit distance is adjusted only when the inter-unit distance change amount is a predetermined value or more.

* * * * *